US007699430B2

(12) United States Patent
Takamiya et al.

(10) Patent No.: US 7,699,430 B2
(45) Date of Patent: Apr. 20, 2010

(54) INK JET PRINTING APPARATUS

(75) Inventors: Hideaki Takamiya, Yokohama (JP); Hitoshi Nishikori, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 413 days.

(21) Appl. No.: 11/859,382

(22) Filed: Sep. 21, 2007

(65) Prior Publication Data

US 2008/0079765 A1 Apr. 3, 2008

(30) Foreign Application Priority Data

Sep. 28, 2006 (JP) ..... 2006-265359

(51) Int. Cl.
*B41J 29/393* (2006.01)

(52) U.S. Cl. ..... 347/19

(58) Field of Classification Search ..... 347/12, 347/15, 19, 41, 43; 358/504
See application file for complete search history.

(56) References Cited

U.S. PATENT DOCUMENTS 6,109,722 A * 8/2000 Underwood et al. ..... 347/19
6,244,682 B1 6/2001 Walker et al.
6,629,789 B2 10/2003 Kawatoko
6,714,673 B1 * 3/2004 Ohta ..... 382/167
7,377,613 B2 * 5/2008 Yamazaki et al. ..... 347/19
2007/0057984 A1 3/2007 Takamiya et al.
2008/0143776 A1 6/2008 Konno et al.

FOREIGN PATENT DOCUMENTS

JP 2000-225698 8/2000
JP 2001-239658 9/2001

* cited by examiner

*Primary Examiner*—Lamson D Nguyen
(74) *Attorney, Agent, or Firm*—Fitzpatrick, Cella, Harper & Scinto

(57) ABSTRACT

The present invention is intended to make it possible to form patches that allow for a high precision measurement of a threshold of an electric energy to be supplied to nozzles of a print head, without using a high-precision sensor. To this end, this invention changes the electric energy supplied to the nozzles of the print head stepwise in printing patches that are used to measure an ink droplet ejection state of the nozzles for each level of electric energy. The patch printing involves dividing the nozzle column of the print head into a plurality of nozzle groups and scanning at least one of the nozzle groups a plurality of times over each of the plurality of patch forming areas set on a print medium.

12 Claims, 29 Drawing Sheets

| 1ST SCAN | 2ND SCAN | 3RD SCAN | 4TH SCAN |
|---|---|---|---|
| 576 | 384 | 192 | 0 |
| 577 | 385 | 193 | 1 |
| 578 | 386 | 194 | 2 |
| 579 | 387 | 195 | 3 |
| | | 196 | 4 |
| ⋮ | ⋮ | ⋮ | ⋮ |
| 764 | 572 | 380 | 188 |
| 765 | 573 | 381 | 189 |
| 766 | 574 | 382 | 190 |
| 767 | 575 | 383 | 191 |

| HEAD RANK | PULSE WIDTH (μsec) |
|---|---|
| 63 | 1.21 |
| 62 | 1.2 |
| 61 | 1.19 |
| ⋮ | ⋮ |
| 39 | 0.97 |
| 38 | 0.96 |
| 37 | 0.95 |
| 36 | 0.94 |
| 35 | 0.93 |
| 34 | 0.92 |
| 33 | 0.91 |
| 32 | 0.9 |
| 31 | 0.89 |
| 30 | 0.88 |
| 29 | 0.87 |
| ⋮ | ⋮ |
| 3 | 0.61 |
| 2 | 00.6 |
| 1 | 0.59 |

FIG.14

| 1ST SCAN | 2ND SCAN | 3RD SCAN | 4TH SCAN |
|---|---|---|---|
| 576 | 384 | 192 | 0 |
| 577 | 385 | 193 | 1 |
| 578 | 386 | 194 | 2 |
| 579 | 387 | 195 | 3 |
| | | 196 | 4 |
| ⋮ | ⋮ | ⋮ | ⋮ |
| 764 | 572 | 380 | 188 |
| 765 | 573 | 381 | 189 |
| 766 | 574 | 382 | 190 |
| 767 | 575 | 383 | 191 |

FIG.20

| 1ST SCAN | 2ND SCAN | 3RD SCAN | 4TH SCAN |
|---|---|---|---|
| 576 | 384 | 192 | 0 |
| 588 | 396 | 204 | 12 |
| 600 | 408 | 216 | 24 |
| 612 | 420 | 228 | 36 |
| 624 | 432 | 240 | 48 |
| 636 | 444 | 252 | 60 |
| 348 | 456 | 264 | 72 |
| 660 | 468 | 276 | 84 |
| 672 | 480 | 288 | 96 |
| 684 | 492 | 300 | 108 |
| 696 | 504 | 312 | 120 |
| 708 | 516 | 324 | 132 |
| 720 | 528 | 336 | 144 |
| 732 | 540 | 348 | 156 |
| 744 | 552 | 360 | 168 |
| 756 | 564 | 372 | 180 |

FIG.23

MULTIPASS PRINTING

INK JET PRINTING APPARATUS

BACKGROUND OF THE INVENTION

1. Field of the Invention

The present invention relates to an ink jet printing apparatus that prints on print media by ejecting ink onto it.

2. Description of the Related Art

The ink jet printing apparatus ejects ink droplets from a print head to form images on print media. This ink jet printing apparatus can easily be upgraded to increase a printing speed and enable high-density printing and color-image printing. It also has an advantage of low noise during the printing operation.

The ink jet print head has a plurality of ink ejection openings and liquid paths communicating to the individual ink ejection openings. Each of the liquid paths is provided with a printing element for ejecting ink present in the liquid path from the ink ejection opening. The printing element is formed of an energy conversion element that transforms an electric energy into an ink ejection energy. Among the popular printing elements currently in use are, for example, an electrothermal conversion element (heater) that transforms an electric energy into a thermal energy to eject ink and an electromechanical conversion element (piezoelectric element) that transforms an electric energy into a mechanical energy for ink ejection.

The print head of a type that utilizes heat produced by the electrothermal conversion elements in ejecting ink from the ejection openings applies a voltage to each heater to generate heat. This heat energy boils ink in the ink path to produce a bubble which in turn ejects ink from the ejection opening. In the following description in this specification, a portion including the ink ejection opening, the ink path communicating to the ink ejection opening and the printing element installed in each ink path is called a nozzle.

With the ink jet printing apparatus using such a print head, however, variations are likely to occur among the printing elements such as heaters and piezoelectric elements. Applying a fixed amount of energy to all printing elements without taking such variations into account may result in ink droplets ejected differing in volume or printing elements having different longevities. To deal with this problem, it is a conventional practice, performed before shipping a print head from a factory, to measure an optimal threshold of ejection energy and, based on the threshold, write an optimum value of ejection energy in a memory incorporated in the print head. This allows a user during a printing operation to apply an optimal drive energy to the printing elements for ink ejection.

However, there are variations in a voltage of power supplied to the user for the ink jet printing apparatus and also in a drive voltage for the print head. This means that the optimal value of the drive energy, that was written into the print head during its manufacture, may become deviated out of an appropriate range because of the drive voltage variations. A technology to eliminate variations on the ink jet printing apparatus side is disclosed in Japanese Patent Laid-Open Nos. 2001-239658 and 2000-225698.

The technology disclosed in the Japanese Patent Laid-Open Nos. 2001-239658 and 2000-225698 is as follows. First, measurement patches are formed for each level of heater drive energy by changing it. Next, a density of each of the formed patches is read by a sensor. Then, the drive energy supplied when a blurred patch was formed is set as a threshold energy. Based on the threshold energy, an optimal drive energy to be supplied to the heater is set.

The technology disclosed in the Japanese Patent Laid-Open Nos. 2001-239658 and 2000-225698, however, has the following problem.

That is, in the currently used ink jet print head that has a growing demand for increased density and number of nozzles, the number of nozzles that are driven simultaneously to form a test pattern tends to increase. This in turn may cause a large voltage drop in a current supply circuit to the heaters, resulting in fluctuations of the heater drive voltage. If that happens, the optimum value of the drive energy to be supplied to the heaters becomes difficult to determine precisely.

To deal with this problem, a method may be conceived which, to make a voltage drop unlikely, reduces the number of nozzles driven simultaneously to form a test pattern. Since the number of nozzles used is reduced, the number of dots forming the test pattern also decreases, lowering the density of the patch. The reduced density of the patch results in a slower rate at which the density changes until the patch becomes blurred. Therefore, if a check is made of the blurring condition of the patch by using an ordinary sensor with a low detection precision, a result of the decision made may have large errors. That is, there exists almost no difference in density between a correct pattern, that is printed with a drive energy close to the one used when the patch becomes blurred, and a blurred pattern. As a result, there is a possibility of erroneously determining a correct pattern as a blurred pattern. To avoid this problem a sensor with high accuracy may be used. A high-precision sensor, however, is expensive leading to a cost increase of the printing apparatus.

SUMMARY OF THE INVENTION

In light of the problem described above, an object of the present invention is to provide an ink jet printing apparatus that can measure with high precision a threshold of an electric energy supplied to nozzles of the print head, without having to use a particularly high-precision sensor.

To solve the above problems, the present invention in first aspect provides an ink jet printing apparatus for printing on a print medium by driving printing elements of a print head, the ink jet printing apparatus comprising: a patch printing unit that prints on the print medium a plurality of patches corresponding to a plurality of drive conditions by driving the printing elements based on the plurality of drive conditions; and a determination unit that determines a drive condition to be used from among the plurality of drive conditions corresponding to the plurality of patches, wherein the patch printing unit prints each of the plurality of patches in a plurality of scans of the print head.

Second aspect of the present invention provides an ink jet printing apparatus for printing on a print medium by applying an electric energy to printing elements of a print head to eject ink onto the print medium, the ink jet printing apparatus comprising: a patch printing unit that prints on the print medium a plurality of patches corresponding to different levels of electric energy by changing stepwise the electric energy applied to the printing elements; a sensor that reads the patches printed by the patch printing unit and corresponding to the different levels of electric energy; and a determination unit that determines an electric energy to be supplied to the printing elements according to a result of reading by the sensor; wherein the patch printing unit prints each of the patches corresponding to the different levels of electric energy in a plurality of scans of the print head.

In this invention since each of the patches used to determine the drive conditions (electric energy, drive voltage, drive pulse width, etc.) is formed by scanning the print head a plurality of times, high-density patches can be formed while minimizing power supply voltage variations. This in turn allows the drive conditions (electric energy, drive voltage, drive pulse width, etc.) considering variations characteristic of the apparatus to be determined with high precision.

Further features of the present invention will become apparent from the following description of exemplary embodiments (with reference to the attached drawings).

BRIEF DESCRIPTION OF THE DRAWINGS

FIG. 14 is a table showing a relation between a head rank set for a print head and a threshold drive pulse width set for the head rank;

FIG. 20 is a table showing an example of nozzles used in each of scans performed to print the Pth measuring patches in the first embodiment;

FIG. 23 is a table showing an example of nozzles used in each of scans performed to print the Pth measuring patches in the third embodiment;

DESCRIPTION OF THE EMBODIMENTS

Now, embodiments of this invention will be described in detail by referring to the accompanying drawings.

1. Basic Construction 1.1 Overview of Printing System

Figure 1:
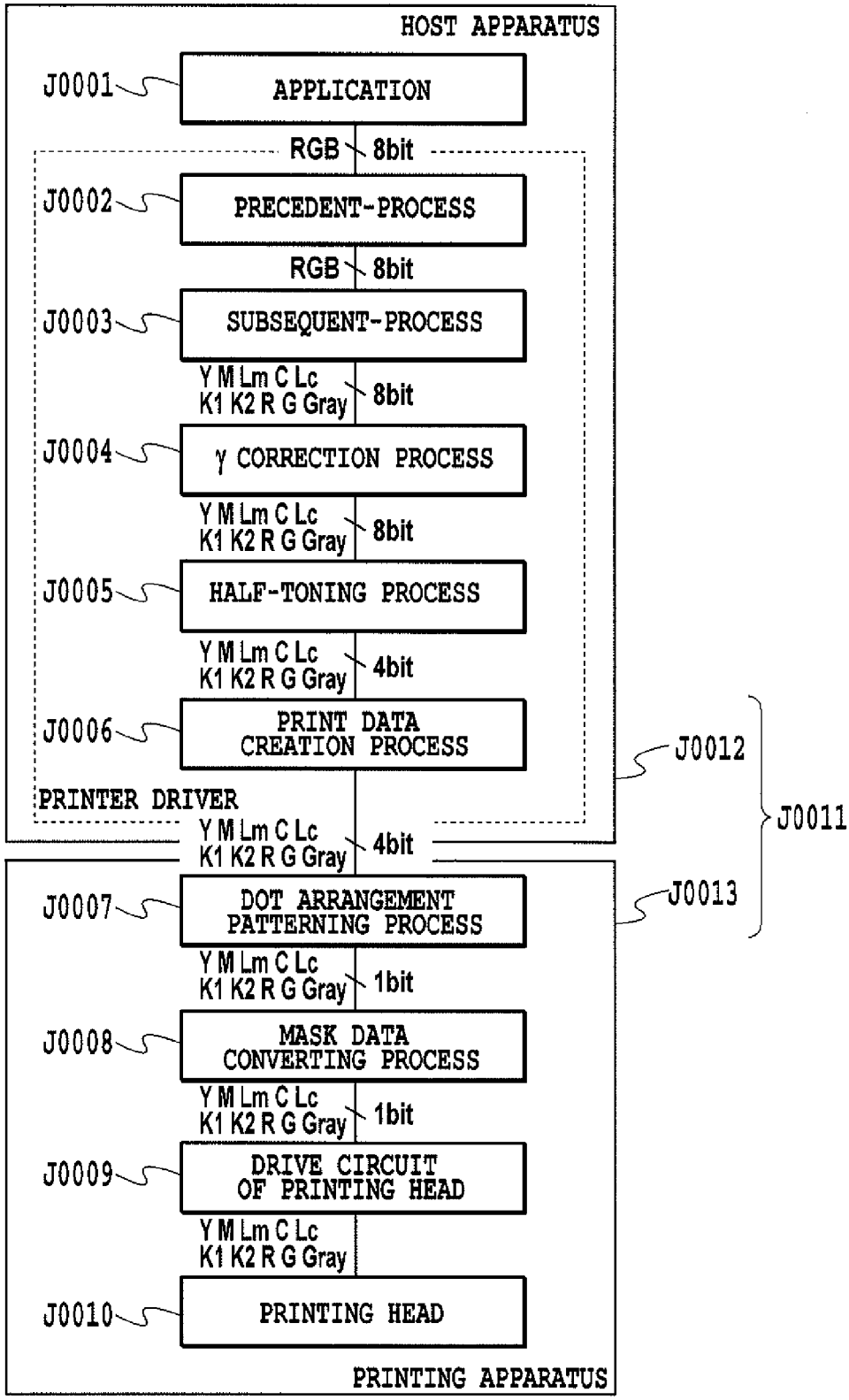
FIG. 1 is a diagram for explaining a flow in which image data are processed in a printing system to which an embodiment of the present invention is applied.

FIG. 1 shows a flow of image data processing in a printing system applied in the embodiments of this invention. The printing system J0011 has a host device J0012 that generates image data representing an image to be printed and sets a UI (user interface) for image data generation. The printing system J0011 also has a printing apparatus J0013 that prints on a print medium based on the image data generated by the host device J0012. The printing apparatus J0013 performs printing by using 10 color inks—cyan (C), light cyan (Lc), magenta (M), light magenta (Lm), yellow (Y), red (R), green (G), first black (K1), second black (K2) and gray (Gray). Therefore a print head H1001 to eject these 10 color inks is used. These color inks are pigmented inks containing pigments as colorants.

Programs running on an operating system of the host device J0012 include applications and a printer driver. An application J0001 generates image data to be printed by the printing apparatus. The image data or data before being edited can be taken into a personal computer (PC) through a variety of media. The host device of this embodiment can take into it through a CF card image data of, for example, JPEG format shot by a digital camera. It can also accept image data of TIFF format read by a scanner and those stored in CD-ROMs. Even data on the Web can be taken in via the Internet. These data thus taken in are displayed on a monitor of the host device in which they are edited and processed by the application J0001 to generate image data R, G, B conforming to, say, the sRGB standard. In a UI screen displayed on the monitor of the host device J0012, the user makes setting of a kind of print medium used for printing and a print quality and then issues a print command. In response to this print command, the image data R, G, B are transferred to the printer driver.

The printer driver has a first-half process J0002, a second-half process J0003, a γ correction process J0004, a halftoning process J0005 and a print data creation process J0006. These processes J0002-J0006 executed by the printer driver will be briefly explained as follows.

(A) Precedent Process

The precedent process J0002 performs a gamut mapping. In this embodiment, a data conversion is done to map a color space represented by the image data R, G, B of the sRGB standard into a gamut that can be reproduced by the printing apparatus J0013. More specifically, 8-bit 256-gradation image data R, G, B are converted into 8-bit data R, G, B within the gamut of the printing apparatus J0013 by using a three-dimensional lookup table (LUT).

(B) Subsequent Process

The subsequent process J0003, based on the gamut-mapped 8-bit data R, G, B, determines 8-bit 10-color color separation data Y, M, Lm, C, Lc, K1, K2, R, G, Gray corresponding to a combination of inks that reproduces the color represented by the gamut-mapped 8-bit data R, G, B. In this embodiment, this process is executed by interpolating the three-dimensional LUT as in the first-half process.

(C) γ Correction Process

The γ correction process J0004 performs a density value (gradation value) conversion for each color of the color separation data determined by the subsequent process J0003. More specifically, by using one-dimensional LUTs corresponding to the gradation characteristics of the individual color inks of the printing apparatus J0013, the conversion executed by the γ correction process J0004 linearly matches the color separation data to the gradation characteristics of the printer.

(D) Halftoning Process

The halftoning process J0005 performs a quantization to convert each of the γ-corrected 8-bit color separation data Y, M, Lm, C, Lc, K1, K2, R, G, Gray into 4-bit data. In this embodiment, an error diffusion method is used to transform the 8-bit 256-gradation data into 4-bit 9-gradation data. This 4-bit data will become an index representing an arrangement pattern in a dot arrangement patterning process executed in the printing apparatus.

(E) Print Data Creation Process

As a last step executed by the printer driver, the print data creation process J0006 generates print data by adding information on print control to print image data containing the 4-bit index data.

Figure 2:
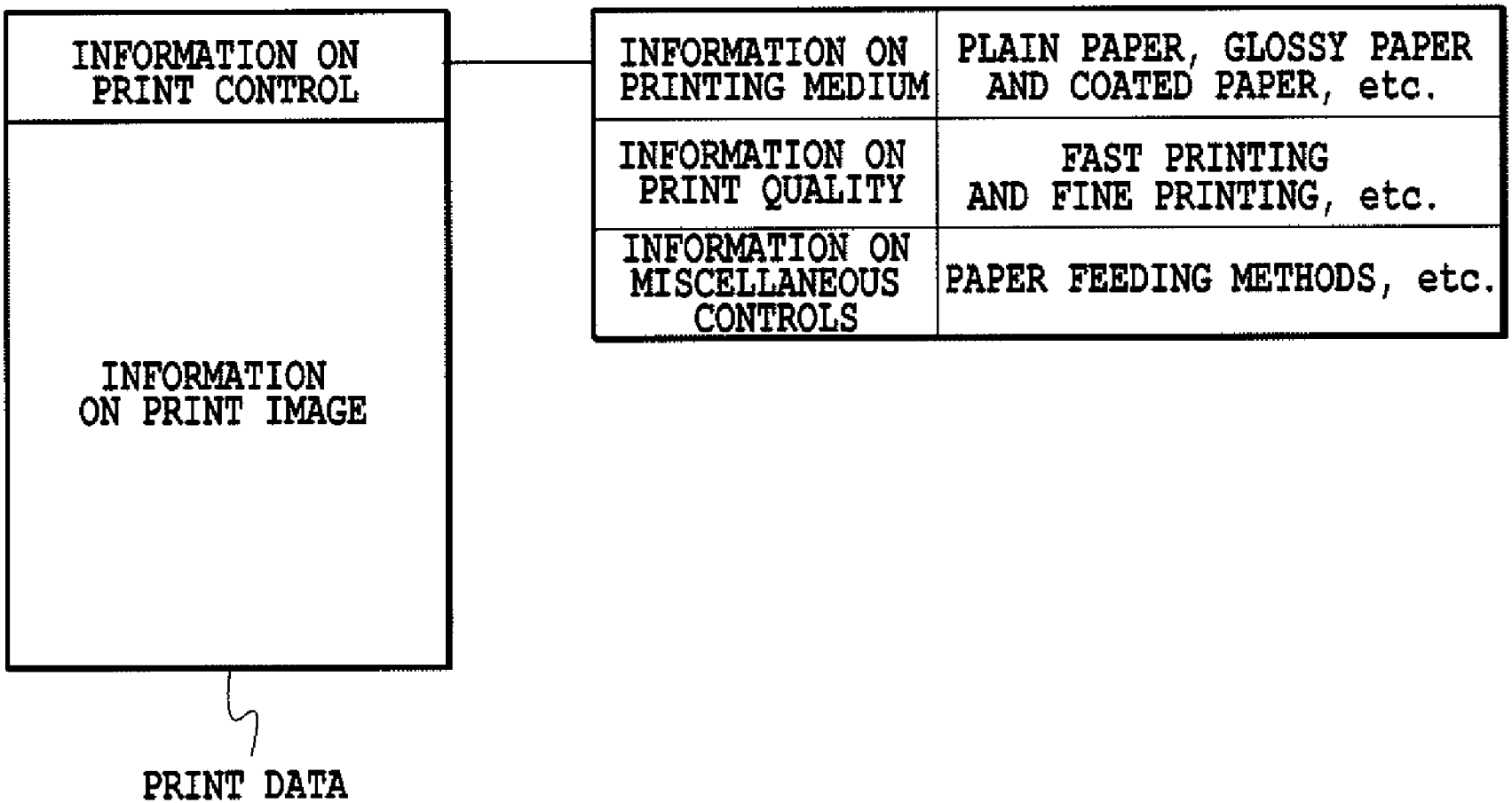
FIG. 2 is an explanatory diagram showing an example of a configuration of print data transferred from a printer driver of a host apparatus to a printing apparatus in the printing system shown in FIG. 1.

FIG. 2 shows an example configuration of the print data. The print data is comprised of print control information used to control the printing operation and print image data representing an image to be printed (the 4-bit index data described above). The print control information contains "information on printing media", "information on print qualities" and "information on miscellaneous controls" defining a paper feeding method and others. The print media information represents the kind of a print medium to be printed, chosen from among plain paper, glossy paper, postcard and printable disk. The print quality information represents the quality of a print, chosen from "fine (high-quality print)", "normal" and "fast (high-speed print)". These print control information are created based on what the user has specified in the UI screen on the monitor of the host device J0012. The print image data describes the image data generated by the halftoning process J0005. The print data generated as described above is supplied to the printing apparatus J0013.

The printing apparatus J0013 performs a dot arrangement patterning process J0007 and a mask data converting process J0008, both described in the following, on the print data fed from the host device J0012.

(F) Dot Arrangement Patterning Process

The halftoning process J0005 described above reduces the number of gradation levels of the multi-valued tone information from 256 levels (8-bit data) down to 9 levels (4-bit data). However, the data that the printing apparatus J0013 can actually print is binary data (1-bit data) indicating whether or not to form an ink dot. Thus, the dot arrangement patterning process J0007 assigns to each pixel, which is represented by 4-bit data with a gradation level 0-8 output from the halftoning process J0005, a dot arrangement pattern corresponding to the gradation level (0-8) of the pixel. This defines a presence or absence of an ink dot (on/off of a dot) in each of sectioned areas of one pixel by putting 1-bit binary data, "1" or "0", in each sectioned area. Here, "1" is binary data indicating that a dot is to be formed in the associated sectioned area and "0" indicates that a dot is not formed.

Figure 3:
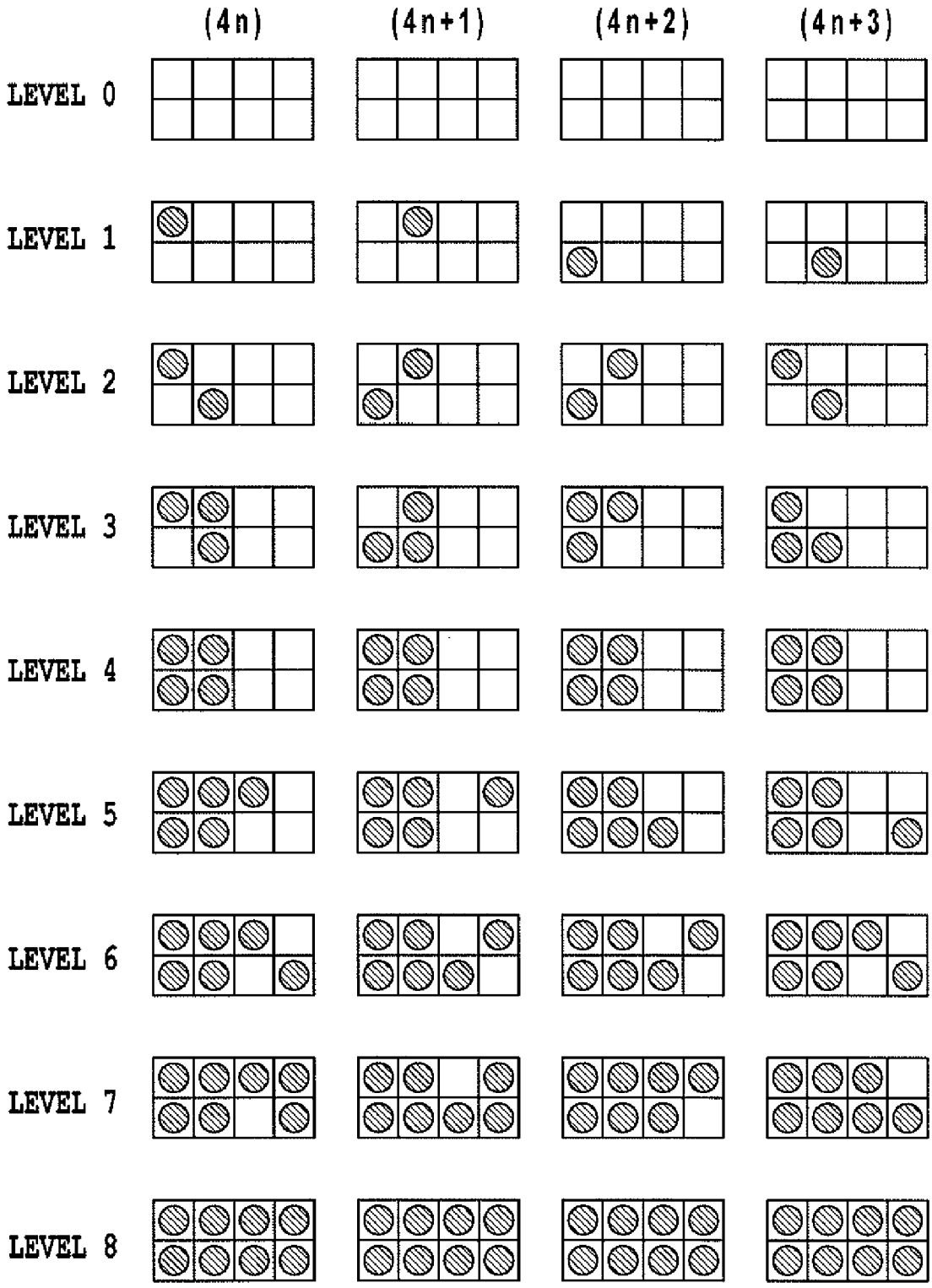
FIG. 3 is a diagram showing output patterns which correspond to input levels, and which are obtained by conversion in a dot arrangement patterning process in the printing apparatus used in the embodiment.

FIG. 3 shows output patterns that corresponds to input levels 0-8 and which is used for conversion performed in the dot arrangement patterning process according to this embodiment. Levels 0-8 shown at the left of the figure correspond to the levels of output from the halftoning process on the host device side. Areas shown at the right, each region composed of vertically arrayed 2 areas times horizontally arrayed 4 areas, match a region of one pixel output from the halftoning process. Individual sectioned areas in one pixel correspond to a minimum unit in which the on/off of dot is defined. In this specification, "pixel" means a minimum unit that can represent a gradation level and is also a minimum unit that is processed by multi-bit multi-valued data image processing (including precedent, subsequent, γ correction and halftoning processes).

In the FIG. 3, areas marked with a shaded circle represent those sectioned areas where a dot is to be formed. As the level value goes higher, the number of dots to be printed also increases by one at a time. In this embodiment, the density information of an original image is eventually reflected in this way.

(4n)-(4n+3), where n is substituted with an integer 1 or higher, represents a horizontal pixel position from the left end of image data to be printed. Patterns shown in four columns of (4n) to (4n+3) indicate that, even at the same input level, a plurality of different patterns are prepared according to pixel positions. That is, if the same levels are input, four kinds of dot arrangement patterns shown below (4n) to (4n+3) are cyclically assigned to printing on a print medium.

In FIG. 3, a vertical direction is set as a direction in which ejection openings are arrayed in the print head and a horizontal direction as a direction in which the print head is scanned. This arrangement that allows a plurality of different dot arrangement patterns to be used for the same level has an effect of equalizing the number of ejections between the nozzles situated at the upper tier of the dot arrangement patterns and those situated at the lower tier. It also offers an advantage of dispersing various noise characteristic of the printing apparatus.

With the above dot arrangement patterning process J0007 completed, all the dot arrangement patterns on the print medium are determined.

(G) Mask Data Converting Process

Since the presence or absence of dot in each square on the print medium has been determined by the dot arrangement patterning process J0007, a desired image can now be printed by inputting the binary data representing the dot arrangements into a drive circuit J0009 of the print head H1001. In that case, a so-called 1-pass printing is executed which completes in a single scan the printing operation in one scan area on the print medium. It is also possible to use a so-called multipass printing that performs a plurality of scans in completing the printing operation in one scan area on the print medium. Here an example of multipass printing will be explained.

Figure 4:
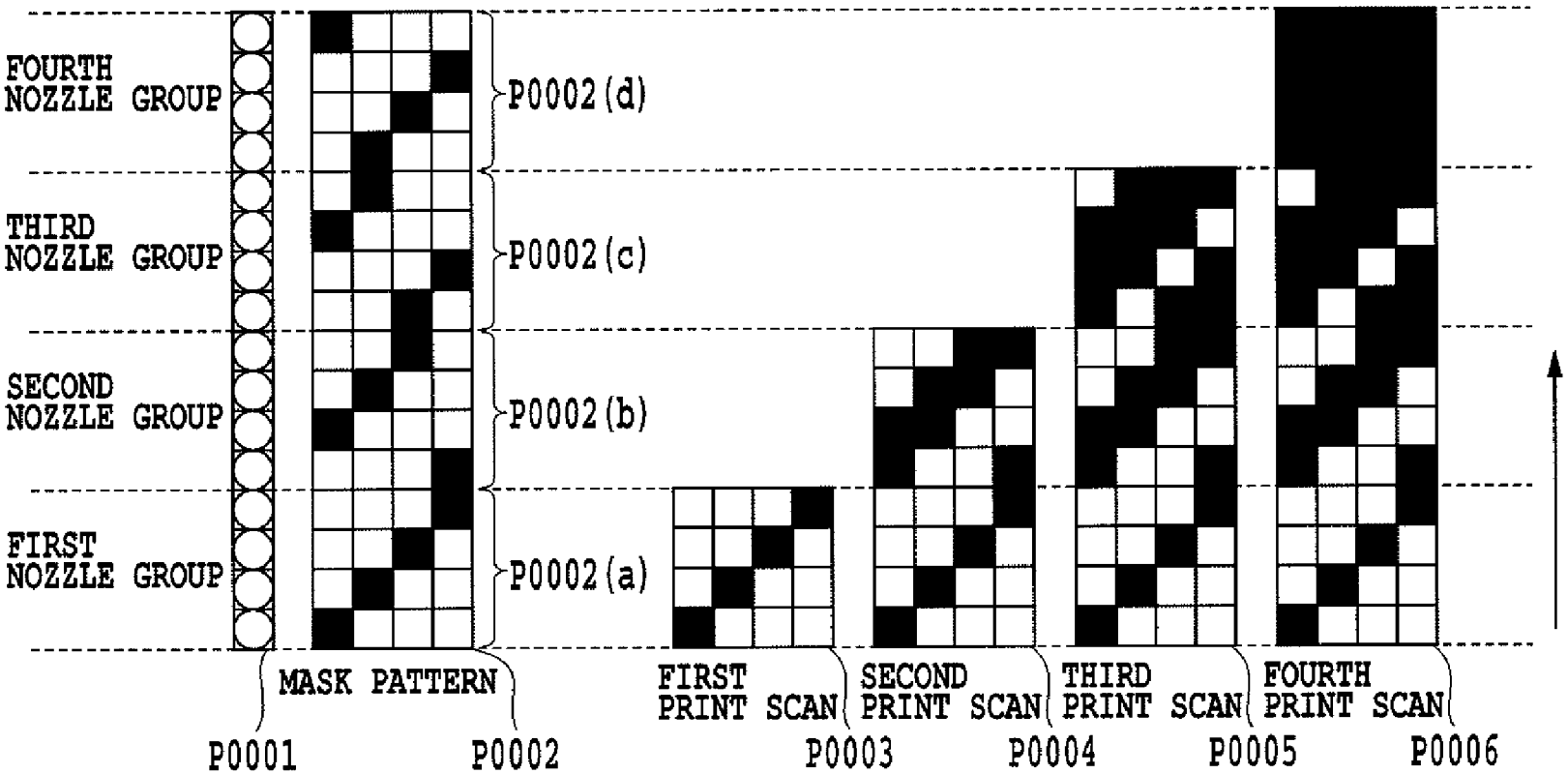
FIG. 4 is a schematic diagram for explaining a multi-pass printing method which is performed by the printing apparatus used in the embodiment.

FIG. 4 schematically illustrates a print head and print patterns for explanation of the multipass printing method. The print head H1001 used in this embodiment actually has 768 nozzles. But for simplicity of explanation, the head is shown to have only 16 nozzles. As shown in the figure, the nozzles are divided into four nozzle groups—first to fourth nozzle group—each composed of four nozzles. Mask P0002 is made up of first to fourth mask pattern P0002*a*-P0002*d*. The first to fourth mask pattern P0002*a*-P0002*d* each define areas where the first to fourth nozzle group can print. Black-painted areas represent print-allowed areas while blank areas represent print-not-allowed areas. The first to fourth mask pattern P0002*a*-P0002*d* are complementary to each other and these four mask patterns, when overlapped, complete the printing in an region corresponding to the 4×4 areas.

The patterns P0003-P0006 show how images are progressively formed as the printing scan is executed repetitively. Each time one printing scan is finished, the print medium is fed a distance equal to the width of one nozzle group (in this figure, equal to four nozzles) in the direction of arrow in the figure. Thus, an image in one area of the print medium (corresponding to the width of each nozzle group) is completed in four printing scans. Completing the printing on each area of the print medium with a plurality of nozzle groups in a plurality of scans has an effect of reducing variations characteristic of nozzles and also variations in a print medium feeding accuracy.

In this embodiment the mask data shown in FIG. 4 is stored in a memory installed in the printing apparatus body. The mask data converting process J0008 performs an AND operation on the mask data and the binary data obtained by the above dot arrangement patterning process to determine binary data to be printed in each printing scan. The binary data thus determined is sent to the drive circuit J0009, which in turn drives the print head H1001 to eject ink according to the binary data.

In FIG. 1, the precedent process J0002, the subsequent process J0003, the γ correction process J0004, the halftoning process J0005 and the print data creation process J0006 have been shown to be executed by the host device J0012, whereas the dot arrangement patterning process J0007 and the mask data converting process J0008 are executed by the printing apparatus J0013. The present invention, however, is not limited to this configuration. For example, a part of the processes J0002-J0005 that are executed by the host device J0012 may be executed by the printing apparatus J0013; or all the processes J0002-J0008 may be executed by the host device J0012. It is also possible to execute the processes J0002-J0008 in the printing apparatus J0013.

1.2 Construction of Mechanical Sections

The construction of each of the mechanical sections used in the printing apparatus of this embodiment will be explained. The mechanical sections of the printing apparatus body of this embodiment may be largely classified according to their role into a paper feeding section, a paper conveying section, a paper discharging section, a carriage section, a and a cleaning section. These mechanical sections are accommodated in an outer case. The cleaning section cleans a nozzle face of the print head.

Figure 5:
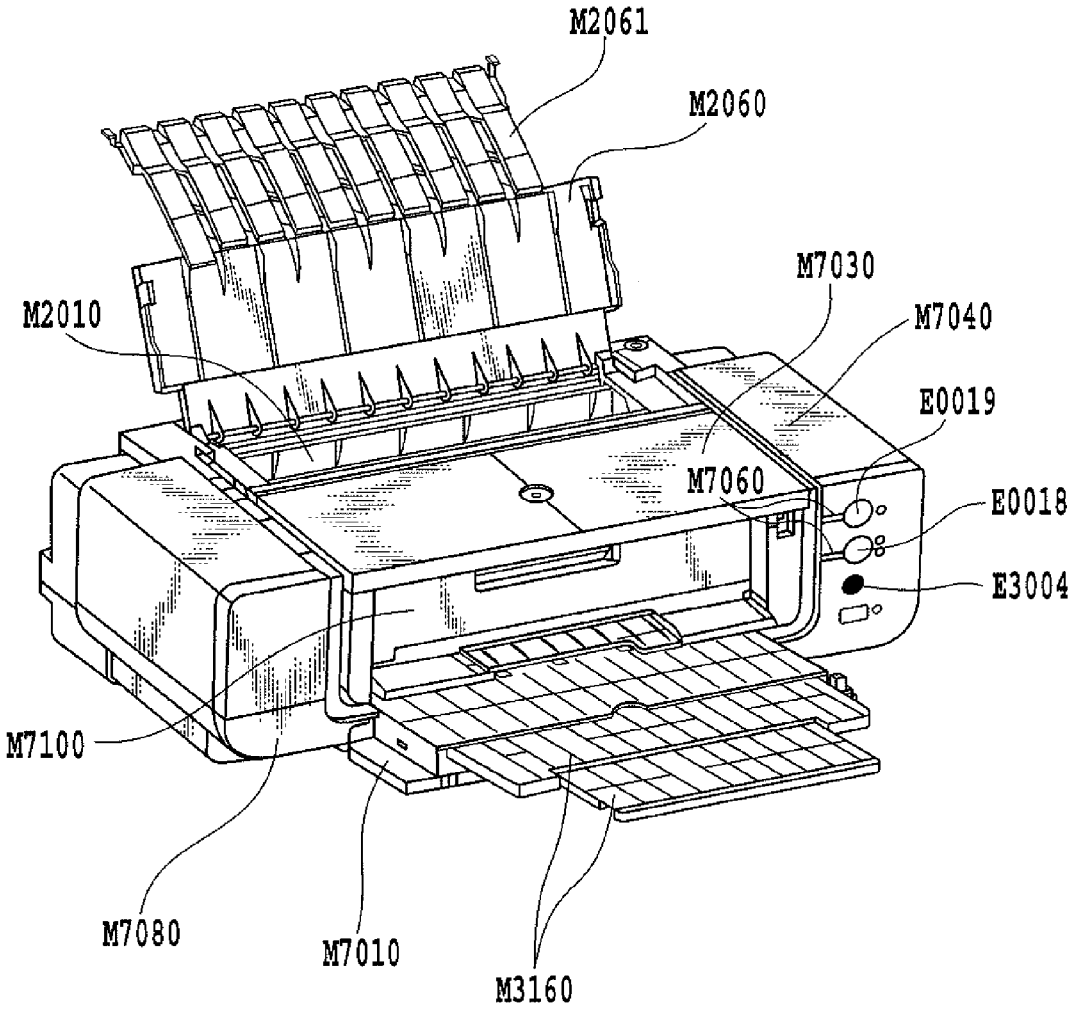
FIG. 5 is a diagram for explaining an internal mechanism of the main body of the printing apparatus used in the embodiment, and is a perspective view showing the printing apparatus when viewed from the right above.
Figure 6:
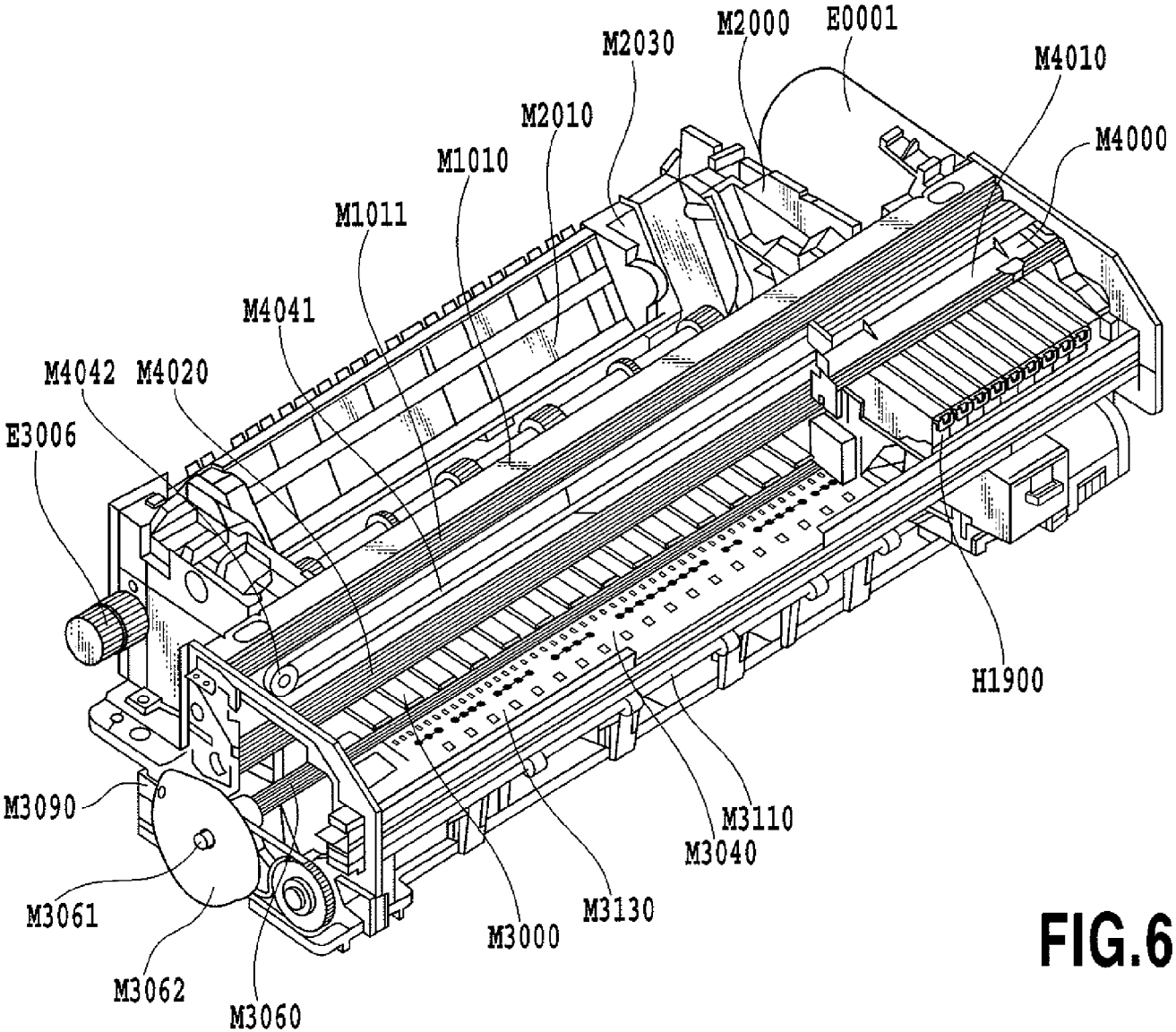
FIG. 6 is another diagram for explaining the internal mechanism of the main body of the printing apparatus used in the embodiment, and is another perspective view showing the printing apparatus when viewed from the left above.
Figure 7:
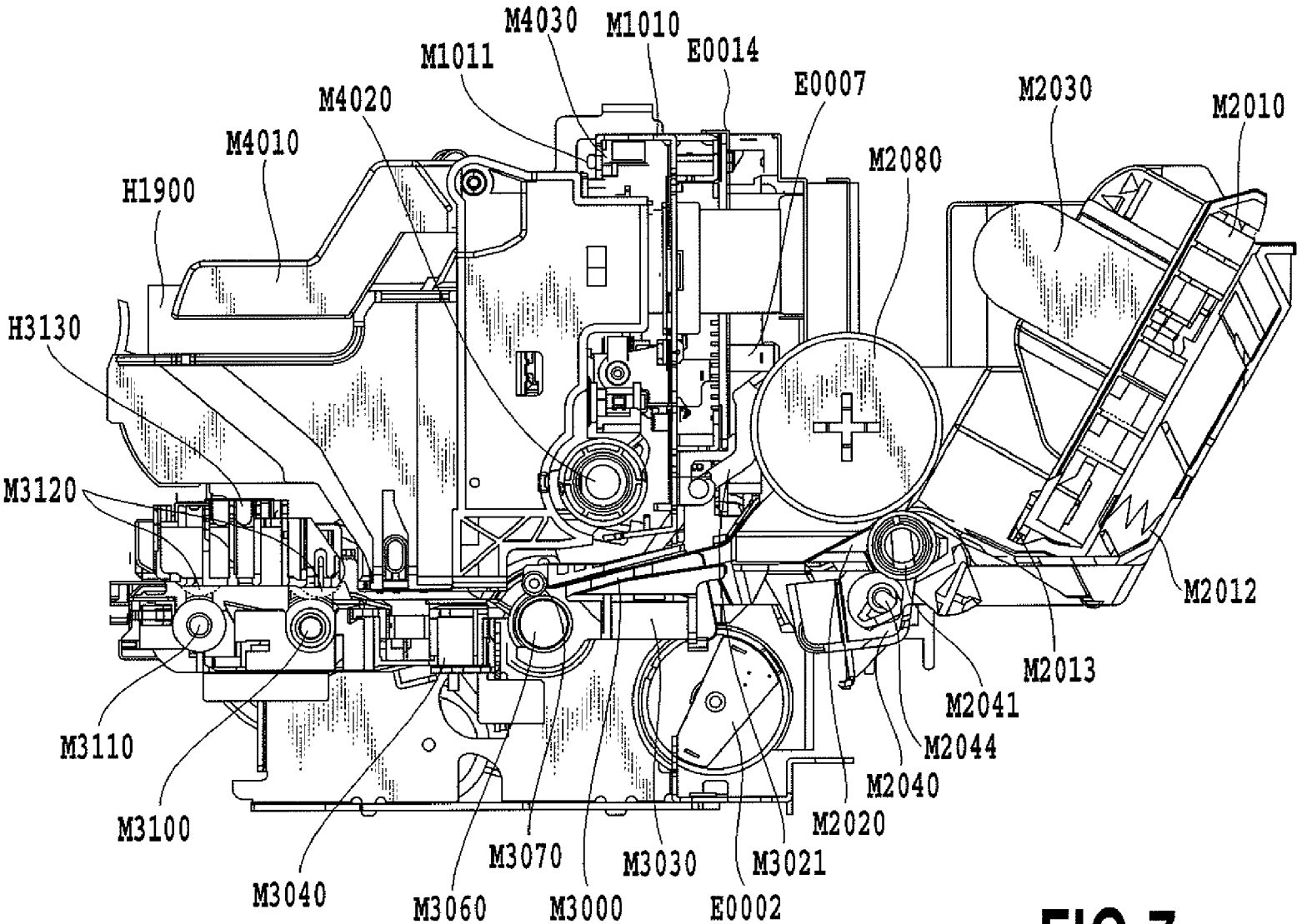
FIG. 7 is a side, cross-sectional view of the main body of the printing apparatus used in the embodiment for the purpose of explaining the internal mechanism of the main body of the printing apparatus.

FIG. 5 is a perspective view of the printing apparatus of this embodiment while in use, as seen from diagonally right and above in front. FIG. 5 to FIG. 7 show internal mechanisms inside the printing apparatus body. Here, FIG. 6 is a perspective view of the internal mechanisms as seen from diagonally right and above in front and FIG. 7 is a side cross-sectional view of the printing apparatus body.

Now, the individual mechanical sections will be explained by referring to these figures.

(A) Outer Case (Refer to FIG. 5)

The outer case is attached to the main body of the printing apparatus in order to cover the paper feeding section, the paper conveying section, the paper discharging section, the carriage section, the cleaning section, the flat-pass section and the wetting liquid transferring unit. The outer case is configured chiefly of a lower case M7080, an upper case M7040, an access cover M7030, a connector cover, and a front cover M7010.

Paper discharging tray rails (not illustrated) are provided under the lower case M7080, and thus the lower case M7080 has a configuration in which a divided paper discharging tray M3160 is capable of being contained therein. In addition, the front cover M7010 is configured to close the paper discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 or the printing head H1001 (refer to FIG. 10) is replaced with a new one in this position. Incidentally, in the printing apparatus of this embodiment, the printing head H1001 has a configuration in which a plurality of ejecting portions are formed integrally into one unit. The plurality of ejecting portions corresponding respectively to a plurality of mutually different colors, and each of the plurality of ejecting portions is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat-pass key E3004 and the like. The door switch lever detects whether the access cover M7030 is opened or closed. Each of the LED guides M7060 transmits, and displays, light from the respective LEDs. Furthermore, a multistage paper feeding tray M2060 is turnably attached to the upper case M7040. While the paper feeding section is not used, the paper feeding tray M2060 is contained within the upper case M7040. Thus, the upper case M7040 is configured to function as a cover for the paper feeding section.

The upper case M7040 and the lower case M7040 are attached to each other by elastic fitting claws. A part provided with a connector portion therebetween is covered with a connector cover (not illustrated).

(B) Paper Feeding Section (Refer to FIG. 7)

As shown in FIG. 7, the paper feeding section is configured as follows. A pressure plate M2010, a paper feeding roller M2080, a separation roller M2041, a return lever M2020 and the like are attached to a base M2000. The pressure plate M2010 is that on which printing media are stacked. The paper feeding roller M2080 feeds the printing media sheet by sheet. The separation roller M2041 separates a printing medium. The return lever M2020 is used for returning the printing medium to a stacking position.

(C) Paper Conveying Section (Refer to FIGS. 6 and 7)

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch rollers M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which a printing medium is conveyed. The paper guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper end sensor (hereinafter referred to as a "PE sensor") E0007 fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 is provided at a side downstream in a direction in which the conveying roller M3060 conveys the printing medium.

Descriptions will be provided for a process of conveying printing medium in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the paper discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

(D) Paper Discharging Section (Refer to FIGS. 6 and 7)

The paper discharging section is configured of a first paper discharging roller M3100, a second paper discharging roller M3110, a plurality of spurs M3120 and a gear train.

The first paper discharging roller M3100 is configured of a plurality of rubber portions provided around the metal shaft thereof. The first paper discharging roller M3100 is driven by transmitting the driving force of the conveying roller M3060 to the first paper discharging roller M3100 through an idler gear.

The second paper discharging roller M3110 is configured of a plurality of elastic elements M3111, which are made of elastomer, attached to the resin-made shaft thereof. The second paper discharging roller M3110 is driven by transmitting the driving force of the first paper discharging roller M3100 to the second paper discharging roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the paper discharging rollers M3100 and M3110 at predetermined pressures. This configuration enables the spurs 3120 to rotate to follow the two paper discharging rollers M3100 and M3110. Some of the spurs M3120 are provided at the same positions as corresponding ones of the rubber portions of the first paper discharging roller M3110 are disposed, or at the same positions as corresponding ones of the elastic elements M3111 are disposed. These spurs chiefly generates a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the paper discharging rollers M3100 and M3110.

With the foregoing configuration, a printing medium on which an image is formed is pinched with nips between the first paper discharging roller M3110 and the spurs M3120, and thus is conveyed. Accordingly, the printing medium is delivered to the paper discharging tray M3160. The paper discharging tray M3160 is divided into a plurality of parts, and has a configuration in which the paper discharging tray M3160 is capable of being contained under the lower case M7080 which will be described later. When used, the paper discharging tray M3160 is drawn out from under the lower case M7080. In addition, the paper discharging tray M3160 is designed to be elevated toward the front end thereof, and is also designed so that the two side ends thereof are held at a higher position. The design enhances the stackability of printing media, and prevents the printing surface of each of the printing media from being rubbed.

(E) Carriage Section (Refer to FIGS. 6 and 7)

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 8). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 8). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 8). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a row direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in the row direction while the printing head H1001 is making a print. During the sub-scan, the printing medium is conveyed in the column direction by conveying roller M3060. Thereby, the printing apparatus is configured to form an image on the printing medium.

1.3 Configuration of Electrical Circuit

Descriptions will be provided next for a configuration of an electrical circuit of this embodiment.

Figure 8:
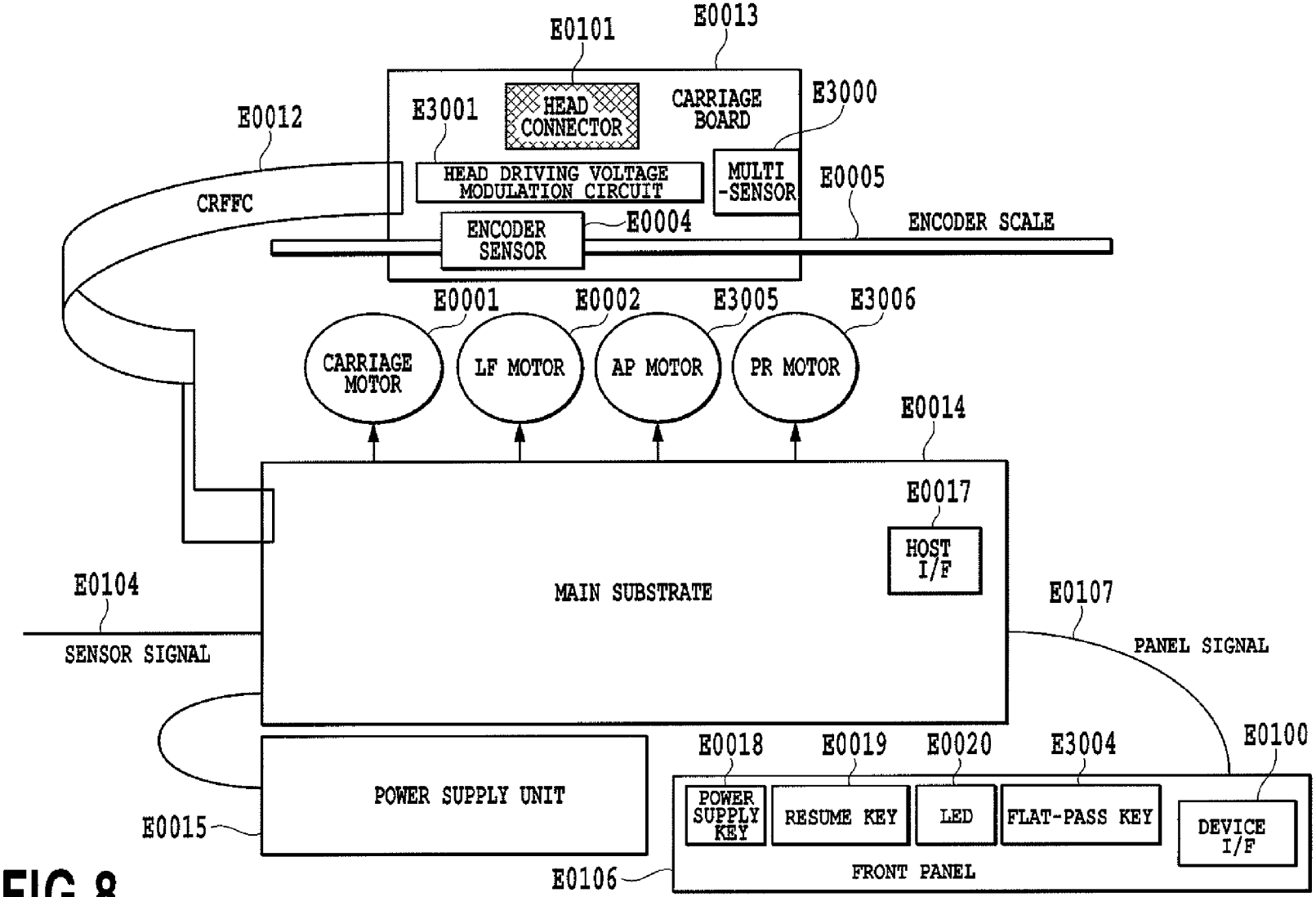
FIG. 8 is a block diagram schematically showing the entire configuration of an electrical circuit in the embodiment of the present invention.

FIG. 8 is a block diagram for schematically describing the entire configuration of the electrical circuit in the printing apparatus J0013. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

An optical sensor E3010 and a thermistor E3020 are connected to the carriage board E0013. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000.

Information obtained by the multisensor system E3000 is outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from the host apparatus J0012 (FIG. 1). The main substrate E0014 is connected to and controls various types of motors including the carriage motor E0001, the LF motor E0002, the AP motor E3005 and the PR motor E3006. The carriage motor E0001 is a motor serving as a driving power supply for causing the carriage M4000 to perform main scan. The LF motor E0002 is a motor serving as a driving power supply for conveying printing medium. The AP motor E3005 is a motor serving as a driving power supply for causing the printing head H1001 to perform recovery operations. The PR motor E3006 is a motor serving as a driving power supply for performing a flat-pass print operation; and the main substrate E0014 thus controls drive of each of the functions. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 5). The front panel E0106 further includes a device I/F E0100 which is used for connecting peripheral devices, such as a digital camera, to the printing apparatus.

Figure 9:
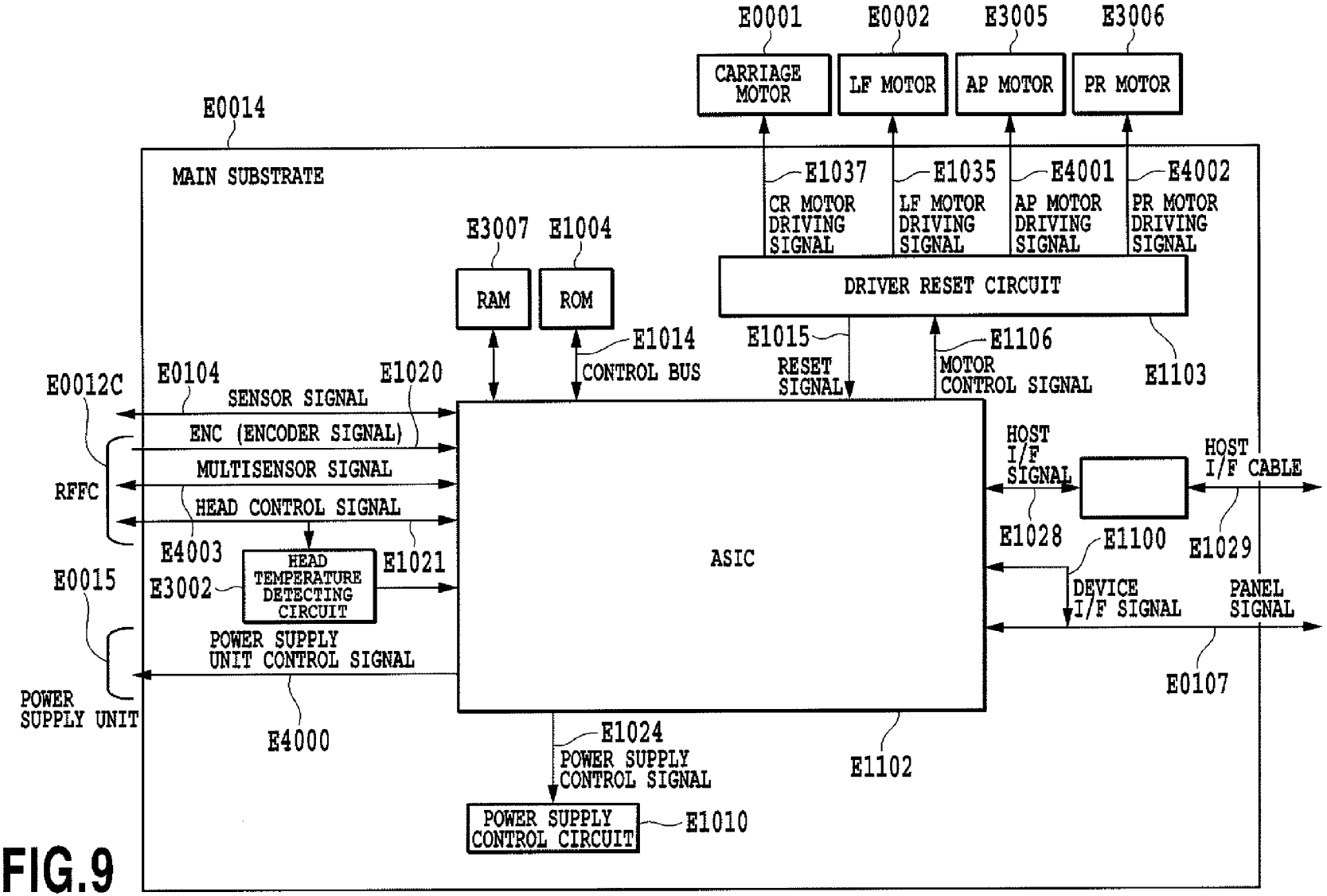
FIG. 9 is a block diagram showing an example of an internal configuration of a main substrate shown in FIG. 8.

FIG. 9 is a block diagram showing an internal configuration of the main substrate E1004.

In FIG. 9, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices.

The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

1.4 Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 10:
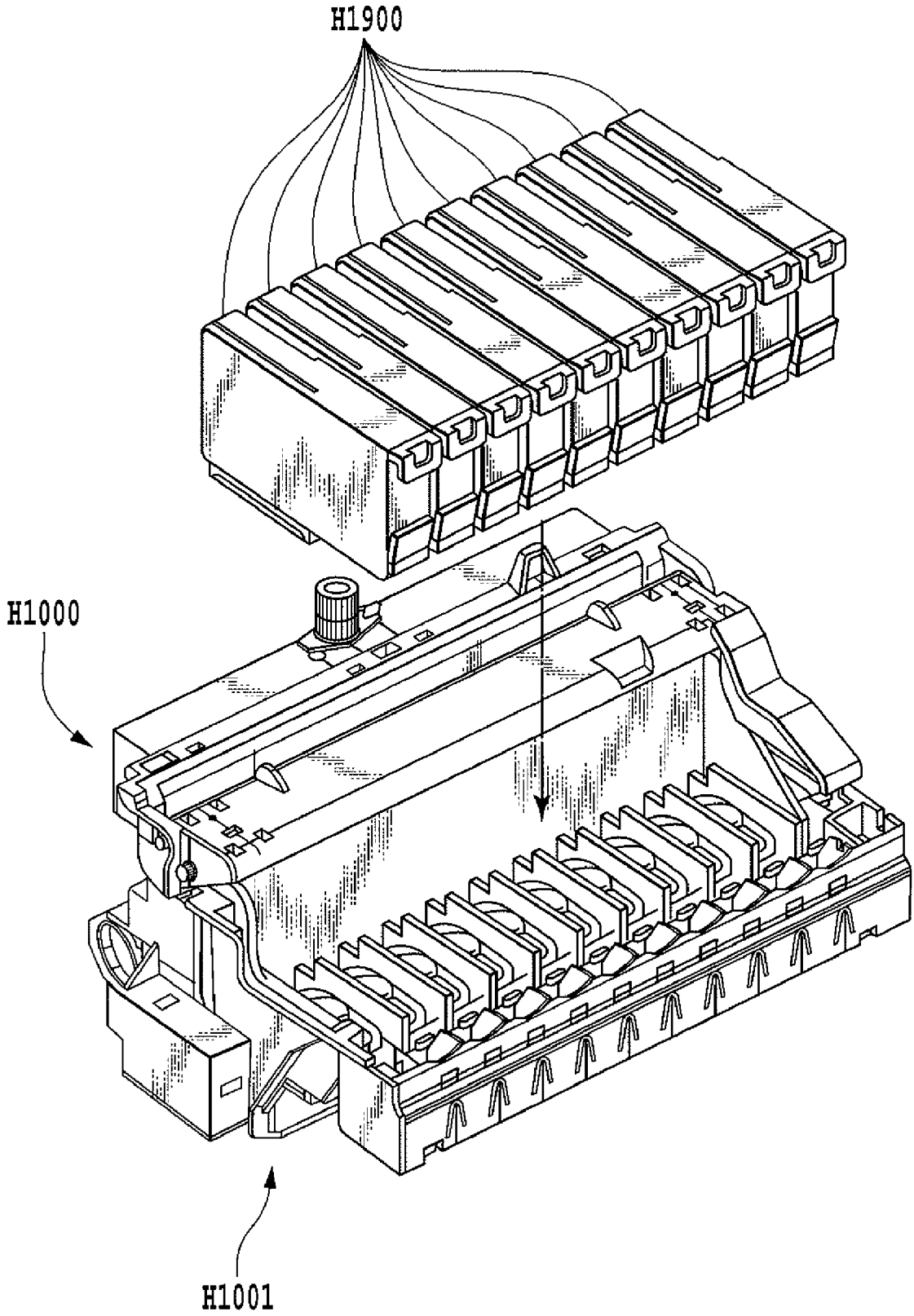
FIG. 10 is a perspective view of a head cartridge and ink tanks applied in the embodiment, which shows how the ink tanks are attached to the head cartridge.

FIG. 10 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 10, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

The print head H1001 has a heater (electrothermal transducer) as a printing element installed in each ink path communicating to an ink ejection opening and uses a thermal energy of the heater to eject ink. That is, by applying an electric energy (or more specifically applying a drive voltage) to the heater to energize it, a bubble is formed in the ink in the ink path, ejecting an ink droplet from the ejection opening.

While a heater (electrothermal transducer) is used here as a printing element, other types of printing element may also be applicable. For example, a piezoelectric element may be used as the printing element. In this case, an electric energy (more specifically, a drive voltage) is applied to the piezoelectric element to cause it to mechanically deform, which in turn produces a pressure change to eject ink from the ejection opening.

2. Characteristic Construction

Next, characteristic constructions of the present invention will be described in connection with first to ninth embodiment.

First Embodiment

Let us first explain about an example configuration of a head drive voltage modulation circuit E3001 used in each embodiment of this invention.

Figure 11:
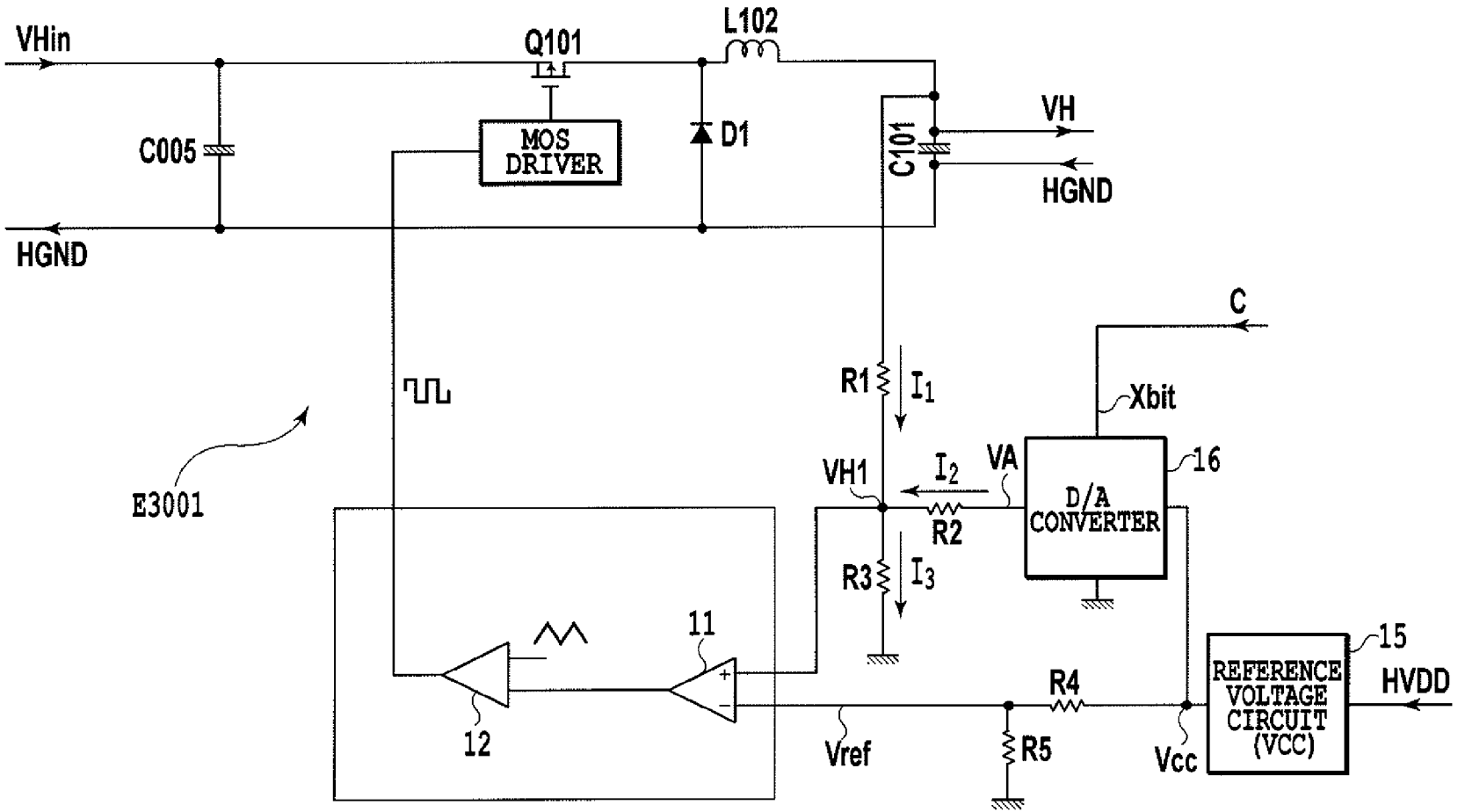
FIG. 11 is a circuit diagram for explaining an example of DC/DC converter in a head drive voltage modulation circuit.

FIG. 11 is a circuitry showing an example of the head drive voltage modulation circuit E3001 on a carriage board E0013.

The head drive voltage modulation circuit E3001 takes in an input voltage VHin from a power supply unit E0015 and produces an output voltage VH to be applied to a heater (electrothermal transducer) in the print head described later. The head drive voltage modulation circuit E3001 has a DC/DC converter to control the output voltage VH. The DC/DC converter operates as follows. First, it compares a divided voltage of the output voltage VH and a reference voltage Vref by an error amplifier 11 and controls the output voltage VH in a way that eliminates an error between them. That is, the error amplifier 11 receives the reference voltage Vref at one of its input terminals (inverted terminal) and, at the other input terminal (non-inverted terminal), a divided voltage VH1 of the output voltage VH, which is divided by resistors R1, R3 as shown in an equation below.

Next, the reference voltage Vref and the divided voltage VH1 are compared by the error amplifier 11 which sends its output, corresponding to a difference between the two voltages, to a comparator 12. The comparator 12 outputs a signal with a pulse width corresponding to the difference between the reference voltage Vref and the divided voltage VH1 to a MOS driver 13, which operates a switching element Q101 according to the signal. The L102 and C101 are an inductance and a reactance making up a smoothing circuit.

By PWM-controlling the switching element Q101 according to the difference between the reference voltage Vref and the divided voltage VH1, the output voltage VH is maintained at a constant voltage corresponding to the reference voltage Vref.

In this example, a current is added by a D/A converter 16 to a voltage dividing point of the output voltage VH in order to change the output voltage VH. The D/A converter 16 receives a reference voltage Vcc generated by a reference voltage circuit 15 and produces an output voltage VA corresponding to a control signal (digital signal) C described later. As a result, a current I2 corresponding to the output voltage VA is added to the voltage dividing point of the registrars R1, R2 through resistor R2. In this case, if we let the input voltage to the D/A converter 16 be Vcc and a value of the 8-bit control signal C be Xbit, the output voltage VA of the D/A converter 16 is expressed as follows.

$$\mathrm{VA} = \frac{Vcc}{2^8} \times Xbit \tag{1}$$

With the current I2 corresponding to the output voltage VA added to the voltage dividing point of the resistors R1, R2, the output voltage VH is changed as follows.

Since the divided voltage VH1 supplied to the non-inverted terminal of the error amplifier 11 is controlled so as to eliminate the difference between it and the reference voltage Vref input to the inverted terminal of the error amplifier 11, currents I1, I2, I3 flowing through the resistors R1, R2, R3 are expressed as follows.

$$I_1 = \frac{VH - Vref}{R1} \tag{2}$$

$$I_2 = \frac{\mathrm{VA} - Vref}{R2}$$

$$I_3 = \frac{Vref}{R3}$$

According to the Kirchhoff's laws, $$I_1 + I_2 = I_3 \tag{3}$$

$$\frac{VH1 - Vref}{R1} + \frac{VA - Vref}{R2} = \frac{Vref}{R3} \tag{4}$$

The output voltage VH is therefore given by $$VH - Vref = R1\left\{\frac{Vref}{R3} - \frac{VA - Vref}{R2}\right\} \quad (5)$$

$$VH = Vref + R1\left\{\frac{Vref}{R3} - \frac{Vref - VA}{R2}\right\}$$

As described above, the output voltage VH can be adjusted by controlling the output voltage VA of the D/A converter 16.

Figure 12:
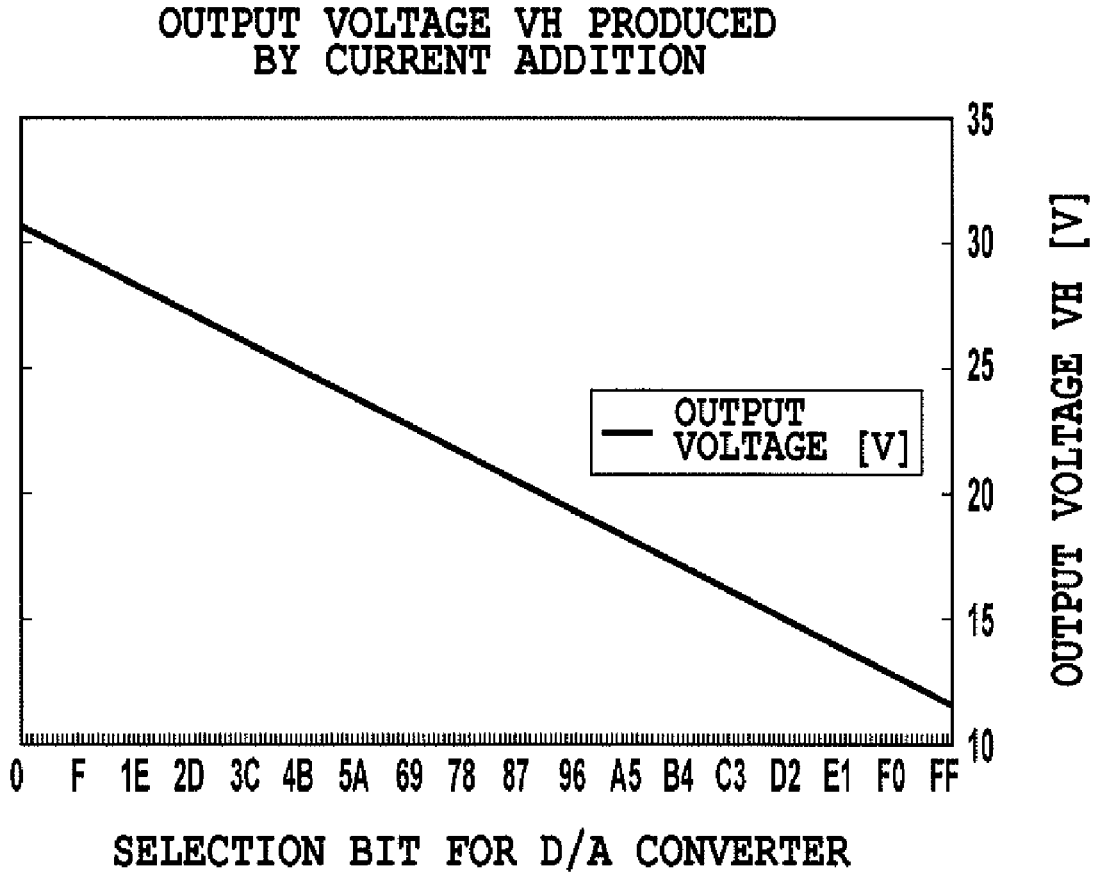
FIG. 12 is an explanatory diagram for an output voltage of the DC/DC converter of FIG. 11.

FIG. 12 shows a correlation between a selected value of the 8-bit control signal C and the output voltage VH. In this example, as the selected value of the control signal C increases, the reference voltage Vref decreases, causing the output voltage VH also to decrease.

Next, how the first embodiment of this invention works will be explained.

In the first embodiment, in addition to a normal printing mode the ink jet printing apparatus has a drive condition setting mode in which to set a drive energy (electric energy) appropriate for a print head mounted in the ink jet printing apparatus. The setting of the desired printing mode can be made using the associated switch provided in the ink jet printing apparatus itself or using a host device connected to the printing apparatus through an interface.

This drive condition setting mode involves lowering stepwise the drive energy to be supplied to the print head while printing a series of drive energy measuring patches on a print medium and, according to the densities of the patches, setting as a boundary value (threshold) a drive energy at which an ink can no longer be ejected and then setting the threshold multiplied by a predetermined coefficient (k) as an optimal drive energy. The most important feature of this embodiment is the method of printing the patches used during the drive energy threshold setting operation.

Figure 13:
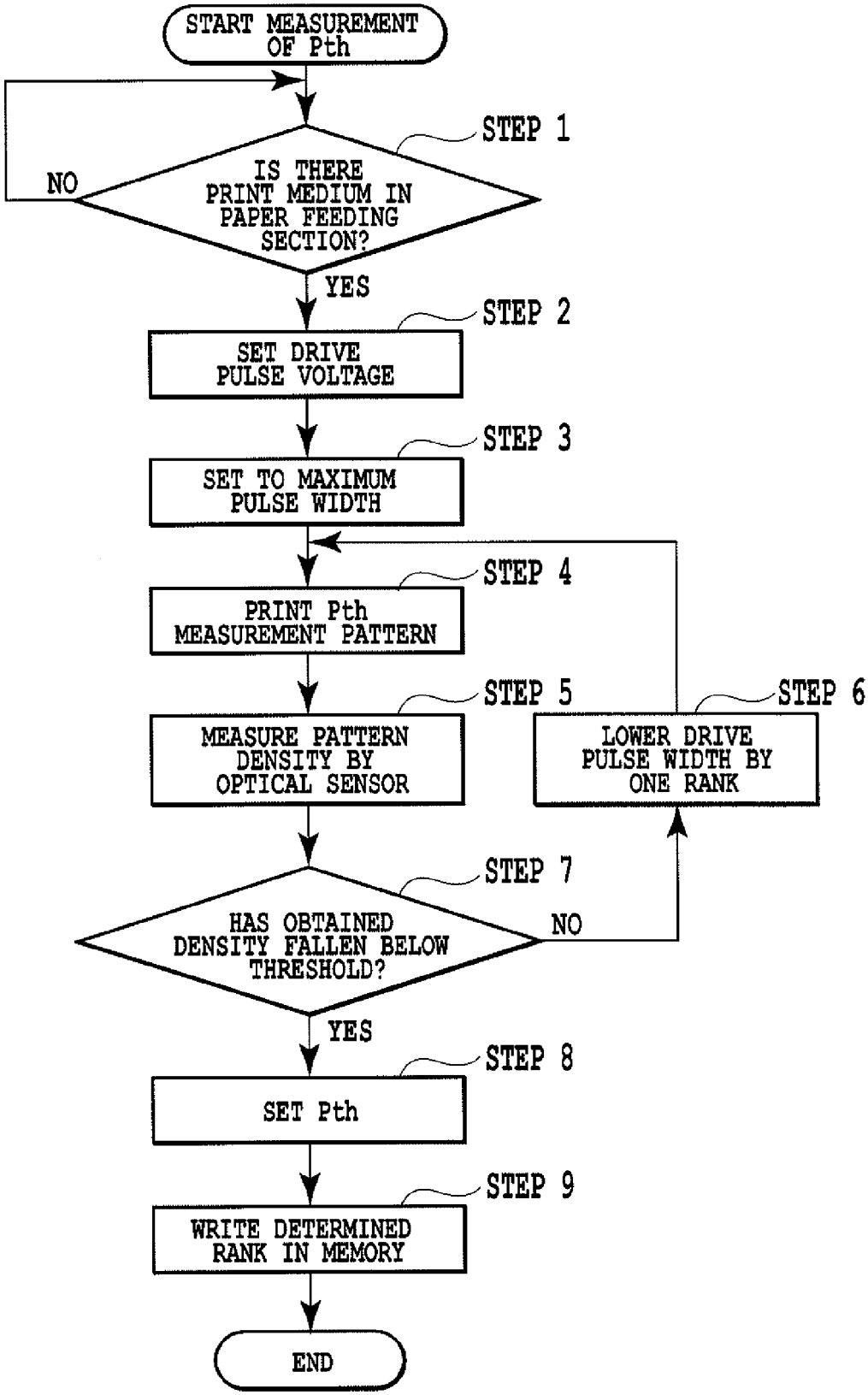
FIG. 13 is a flow chart showing a sequence of steps to measure Pth in a first embodiment.

Before we proceed to explain the pattern printing method characteristic of this embodiment, let us explain the drive energy threshold setting operation, a background technology for the pattern printing method, by referring to the flow chart of FIG. 13.

The drive energy threshold setting operation involves first checking whether a print medium exists in the paper feeding section (step 1) and, if so, setting a voltage of a drive pulse (hereinafter referred to as a drive voltage) for printing the measurement patches (step 2). This drive voltage is set at a threshold voltage Vth which is obtained by dividing the preset output voltage VH used in the ordinary printing operation by a value k (e.g., 2>k>1). While the value k=1.15 is used here, other values may be used.

Next, the width of the drive pulse to be applied to each of the heaters of the print head is set to a maximum pulse width (step 3). Generally, there are variations in planarity among heaters of the print head during a manufacturing stage. These variations in turn produce variations in a minimum drive pulse width that is required to eject ink from the print head (this drive pulse width is also referred to as a threshold drive pulse width Pth). To deal with this problem a step 3 sets as a drive pulse width to be applied to the heaters of the print head a maximum value of a range from the maximum value to a]minimum value of the threshold drive pulse width.

In the memory of the ink jet printing apparatus is stored a table of head rank, in which a range of threshold drive pulse width Pth is divided at intervals of a predetermined pulse width into stages and in which the individual stages are assigned a head rank. FIG. 14 shows an example of the table. Here, a plurality of threshold drive pulse widths Pth (0.59 μsec to 1.21 μsec) are set at intervals of 0.01 μsec and are each provided with a head rank value (1-63). In the ink jet printing apparatus, the drive pulse width to be applied to the heaters of the print head can be set according to the head rank. Therefore, step 3 sets a threshold drive pulse width Pth (1.21 μsec) corresponding to the maximum head rank value (63) in the range of head ranks.

The manufacturer of the print head normally has the similar table. The manufacturer, after measuring the drive pulse width appropriate for each of the manufactured print heads, refers to the table, determines a head rank for each print head, and stores the head rank in the memory of the individual print heads before shipping. The ink jet printing apparatus mounting this print head reads out the head rank from the memory of the print head and can recognize the threshold drive pulse width Pth set by the manufacturer. It should be noted, however, that the threshold drive pulse width corresponding to the head rank set by the manufacturer is not a value that can be applied, as is, to the ink jet printing apparatus but a value that should be used as a criterion or standard. This is because a power supply voltage provided in the ink jet printing apparatus has variations or differences from the power supply voltage used by the maker during the measurement of the threshold drive pulse width Pth. The variations in the power supply voltage cause errors in the drive energy to be supplied to the heaters of the print head. This, combined with the variations in heater planarity, constitutes a problem in the ink ejection operation. Therefore, even in a system in which the printing apparatus side is able to recognize the threshold drive pulse width of each print head set by the manufacturer, it is necessary to newly set the threshold drive pulse width Pth corresponding to the individual printing apparatus by performing the following measurement operation beginning with step 4.

Figure 15:
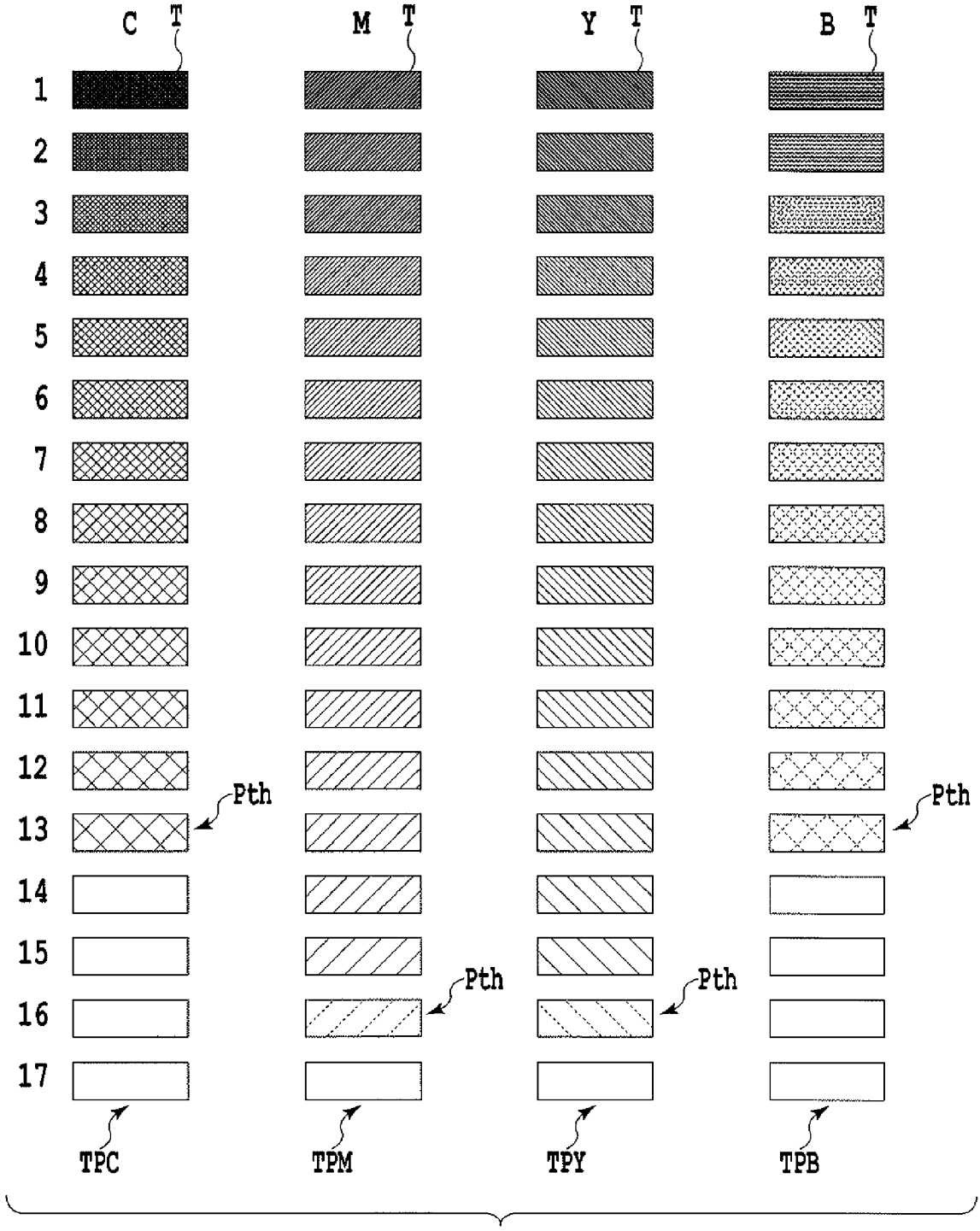
FIG. 15 illustrates a Pth measuring test pattern formed in the first embodiment.
Figure 16:
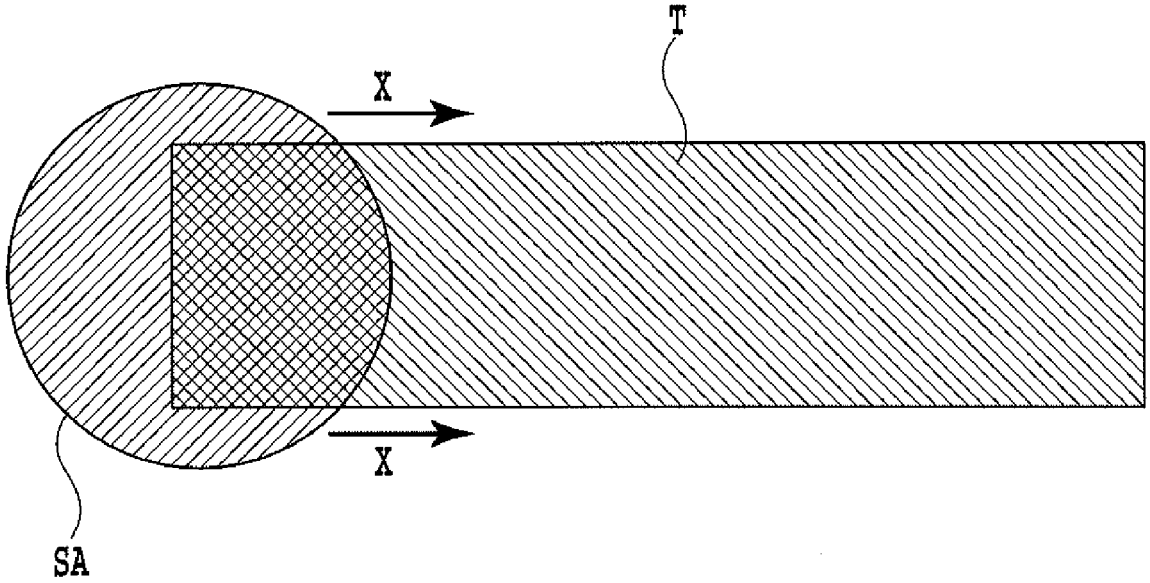
FIG. 16 is an enlarged view of FIG. 15 showing a relation between a patch of FIG. 15 and a measuring range of an optical sensor.

Referring again to FIG. 13, step 4 supplies a drive pulse having a threshold drive voltage set at step 2 and a drive pulse width set at step 3 to the associated heater of the print head to form patches on the print medium that are used for setting the threshold drive pulse width. FIG. 15 and FIG. 16 show one example of the patches formed in this embodiment. FIG. 15 represents measurement patterns each composed of a plurality of patches and printed by different print heads using different color inks. FIG. 16 is an enlarged view of one of the patches in FIG. 15. In FIG. 15, TPC represents a measurement pattern composed of a plurality of patches T formed of a cyan ink; TPM represents a measurement pattern composed of a plurality of patches T formed of a magenta ink; TPY represents a measurement pattern composed of a plurality of patches T formed of a yellow ink; and TPB represents a measurement pattern composed of a plurality of patches T formed of a black ink. Each of the patches T, as shown in FIG. 16, is formed to have a width (in a direction perpendicular to a direction X (main scan direction) in FIG. 16) that is included in a detection area SA of an optical sensor installed in a carriage M4000.

The smaller the line number (1-17) of the patch T in each of the measurement patterns, the wider the drive pulse becomes that is applied to the associated heater to print that patch. Thus, at this point when the maximum drive pulse width is set, only those patches belonging to the first line are printed. While the patches are shown here to be printed with only four color inks, the actual measurement operation forms patches for all the inks (10 color inks) used in this embodiment.

When patches T are formed in the first line of FIG. 15, the optical sensor scans in the main scan direction (X direction of FIG. 16) along with the carriage M4000 to read the density of the patches T (step 5). Next, a check is made as to whether the density of the patches T read in is lower than the preset threshold (see FIG. 17). If the density read in is higher than the preset threshold density, step narrows the drive pulse width by one head rank. That is, step 6 sets the pulse width to 1.2 μsec, that corresponds to the head rank 62, before moving to step 4.

Then, at step 4 the measurement operation prints patches T by using the different color print heads at a position different from the previously printed patches T (here at a second line of FIG. 15) and reads them again by the optical sensor (step 5). If the density read in is still higher than the threshold density, step 6 further narrows the drive pulse width by one head rank (setting the drive pulse width to 1.19 μsec) and then step 4 and step 5 perform the patch printing and the density reading again. The operation of step 4 to step 7 is repeated until the density read by the optical sensor falls below the threshold.

If the density read by the optical sensor becomes lower than the threshold density, a drive pulse width one rank higher than the head rank corresponding to the pulse width set at that point is set as a threshold drive pulse width Pth (step 8). For example, in the measurement pattern of cyan ink in FIG. 15, a patch T in a 14th line printed with a drive pulse width of head rank 50 is lower than the threshold. Thus, a pulse width used to form a patch T in a 13th line of FIG. 15, i.e., the drive pulse width corresponding to the head rank 51 (1.09 μsec), is set as the threshold drive pulse width Pth. As shown in FIG. 15, the threshold drive pulse width Pth differs depending on the ink color. Therefore, the threshold drive pulse setting operation described above is performed for all color print heads. After this, the head rank value corresponding to the set threshold drive pulse width is written into the memory of the ink jet printing apparatus (step 9). With the above steps taken, the operation of measuring the threshold drive pulse width Pth is complete.

Thus, the drive energy that is equal to the measured threshold drive pulse width Pth times the threshold voltage Vth is a boundary value of the drive energy at which the print head can no longer eject ink, or the threshold drive energy. After this measurement operation, the drive voltage returns from VH to Vop used during the normal printing operation. This drive voltage VH is k times the threshold voltage Vth, so the drive energy obtained by multiplying the normal drive voltage VH and the measured threshold drive pulse width Pth is an optimal drive energy equal to k times the threshold drive energy.

Next, the patch printing method, one of the features of this embodiment, will be explained.

Figures 18A, 18B, 18C:
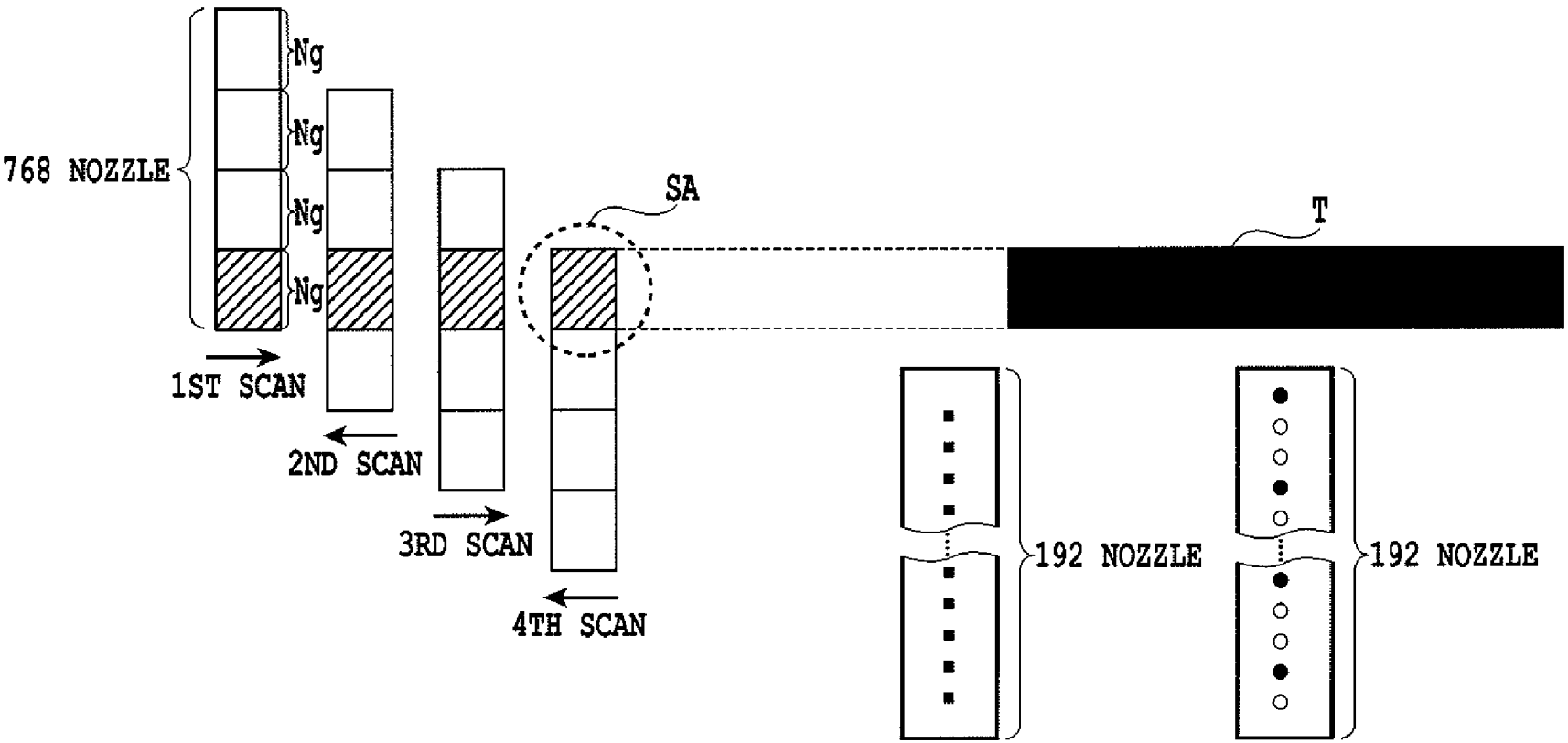
FIG. 18A is a schematic diagram showing an example multipass printing operation performed to print Pth measuring patches in the first to eighth embodiment.
FIG. 18B and FIG. 18C are schematic diagrams showing how nozzles are used during the printing of the Pth measuring patches.

FIG. 18A to FIG. 18C schematically show a print head scanning method during the patch printing performed in this embodiment. Here, an example case is shown in which one patch is formed by one print head. When a patch T is formed by a so-called 1-pass printing method that completes an image in one scan of the print head, the patch can be formed in a short time. However, the 1-pass printing method has a limitation on the number of nozzles that can be used simultaneously in one scan, making it difficult to form a patch T with high density. If the density of a patch is low, the density change or gradient as the patch becomes faded is moderate, compared to the density change when the patch density is higher. So, reading density changes with high precision using an ordinary optical sensor is difficult to achieve. In the measurement of the threshold drive energy, it is desired that one patch T be formed by using as many nozzles in a nozzle column of the print head as possible. However, in the 1-pass printing, as the number of nozzles used increases, the patch formed in one scan increases in size. This in turn widens the area that needs to be measured by the optical sensor, increasing the measurement time, and also makes the decision operation based on the measurements more complicated. The optical sensor moves along with the carriage in the main scan direction to measure the density of a patch T. At this time, if the width of the patch in the nozzle array direction exceeds the width of the measuring area SA of the optical sensor (see FIG. 16), not all of the area of the patch can be detected in one scan by the optical sensor. Therefore, the operation of feeding a print medium after the optical sensor is scanned over the print medium and then scanning over the print medium by using the optical sensor again needs to be repeated, taking much more time to measure the density of one patch. Further, since a decision needs to be made on each density read by each scan, the decision operation becomes more complicated, requiring much more processing time.

To deal with this problem, this embodiment, as shown in FIG. 18A, prints patches T by performing a multipass printing that executes a plurality of scans in one print area. The print head H1001 of this example has a nozzle column comprising a plurality of nozzles (here 768 nozzles) arrayed in a print medium conveying direction (Y direction) perpendicular to the main scan direction (X direction) of the carriage H1000. This nozzle column has a plurality of nozzle groups Ng each made up of one-fourth of the total number of nozzles in the nozzle column. That is, the print head H1001 has four nozzle groups Ng. The width of each nozzle group Ng is set less than the detection width of the optical sensor.

In this embodiment, the patches T are formed by scanning one and the same patch forming area on the print medium with each nozzle group Ng once, i.e., by performing a total of four scans on the same area. Nozzle numbers of each nozzle group used in each scan are shown in FIG. 20.

The printing operation will be described in more detail. In the first scan, the patch forming area is printed using a nozzle group of 192 nozzles from nozzle number 576 to nozzle number 767 (see FIG. 20). Next, the print medium is fed one-fourth the length of the nozzle column. In the second scan, the same patch forming area that was previously printed is printed using another nozzle group of 192 nozzles from nozzle number 384 to nozzle number 575. After this, the print medium is again fed in the same way as described above. In the third scan, the same patch forming area is printed using another nozzle group of 192 nozzles from nozzle number 192 to nozzle number 383. Further, after the print medium is fed as described above, the printing is performed in the fourth scan using 192 nozzles from nozzle number 0 to nozzle number 191. With the above operations performed, a patch T having a width ¼ the length of the nozzle column is printed by using all the nozzles of the print head H1001.

Figure 19A:
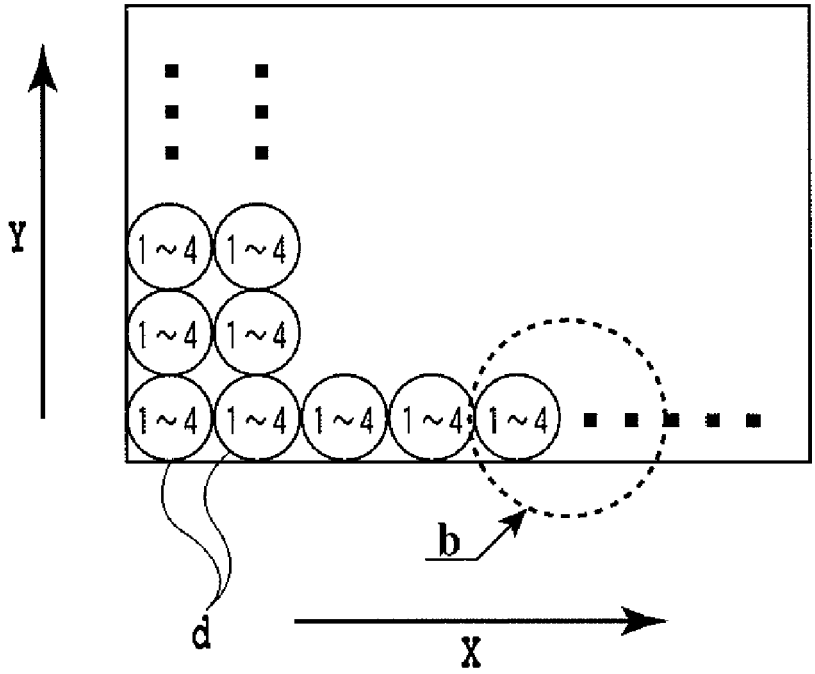
FIG. 19A is a schematic diagram showing how dots are formed when the Pth measuring patches are printed in the first embodiment, with a plurality of dots formed overlapped at the same positions.

The states of dots formed on the print medium by the above printing operation are shown schematically in FIG. 19A. In the figure, d represents a dot formed on the print medium and a number shown inside the dot d represents a scan number which formed that dot (the number 1 inside the dot d represents the first scan and the number 4 represents the fourth scan). As shown in the figure, each dot d is formed by landing ink droplets, ejected in the first to fourth scan, onto the same position overlappingly. Compared with the dots formed by the 1-pass printing which lands only one ink droplet on one dot forming position, the dots formed in this embodiment have increased densities, which in turn increases the overall density of the patch T. This patch printing operation is also executed by other ink color print heads.

Since the width of the printed patch T is within the detection range of the optical sensor as described above, the density of each patch T can be read in a single main scan of the optical sensor. The density of the read patch T is compared to the threshold to see whether it falls below the threshold. This threshold is calculated based on the densities of a blank portion and a solid-printed portion. If we define a sensor reading for a blank portion to be 0% and a sensor reading for a solid-printed portion to be 100%, the threshold density is defined to be n %. This threshold is set for every ink color.

If the above check finds that the measured density of the patch T is not lower than the threshold, the drive pulse width is reduced by one rank, as shown in the flow chart of FIG. 13, and the patch T is printed again for measurement. This printing and density measurement operation is repeated until the density of the patch T becomes lower than the threshold, at which time the drive pulse width that was used to form a patch T immediately before the current patch T of interest is set as the threshold drive pulse width.

Since this embodiment prints the measurement patches by scanning all the nozzle groups (four nozzle groups), which make up the nozzle column of the print head, over the patch forming area having a width ¼ the length of the nozzle column, each of the printed patches T has a higher density than when printed by the 1-pass printing. Thus, when a plurality of patches T are formed, as shown in FIG. 15, a change in density of each patch T as it becomes faded is greater than the one obtained by the 1-pass printing. It is therefore possible to reliably read by the optical sensor a density difference between a patch T immediately before its patch density falls below the threshold and a patch T immediately after its patch density has fallen below the threshold.

Figure 17:
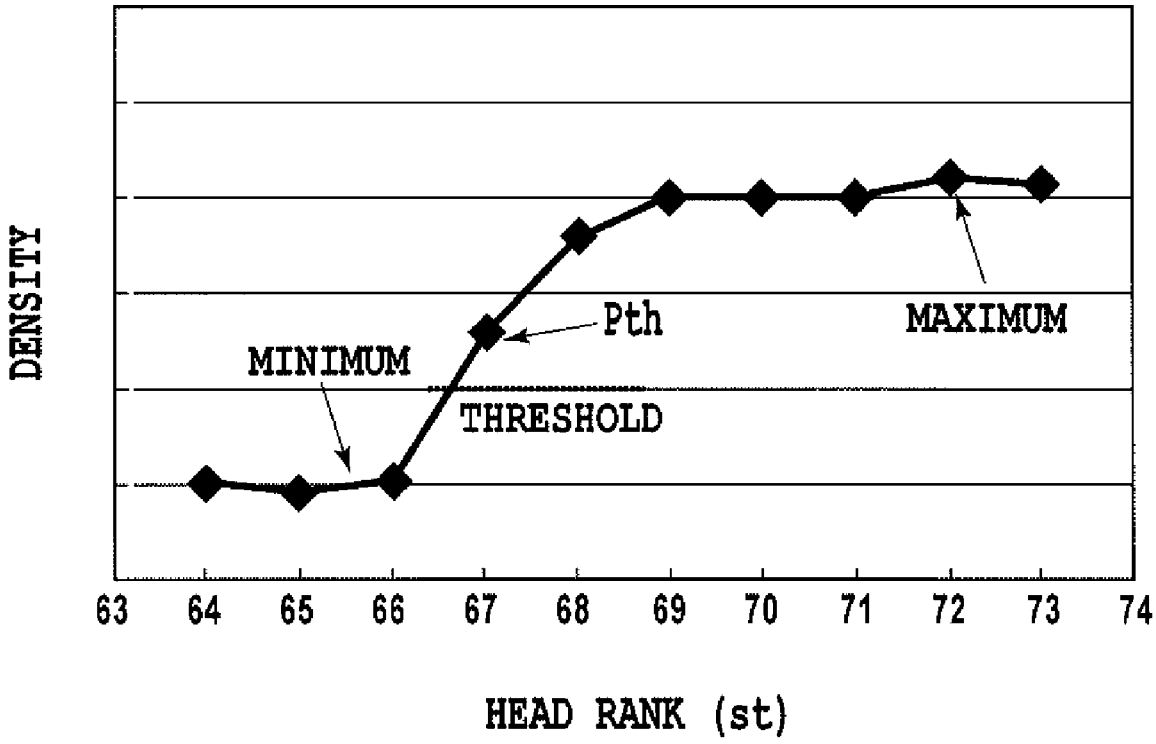
FIG. 17 is a diagram showing a relation between measured gradation levels and heater ranks in the first embodiment.

In this embodiment, the threshold density is set between a density of the patch forming area when the patch forming area is no longer applied ink droplets at all (minimum density value) and a patch density immediately before the patch forming area is no longer applied ink droplets at all (see FIG. 17). Therefore, it is necessary to read by an optical sensor a density difference produced by the landing of very small ink droplets in the patch forming area. In this embodiment, however, since the density of each dot is greater than when the 1-pass printing is done, even the density of the patch forming area where very small volumes of ink droplets have landed can be measured precisely by an optical sensor having an ordinary precision. This makes it possible to reliably determine the threshold drive pulse width and therefore, based on this threshold drive pulse width, an optimal ejection energy can be set.

Further, since the number of nozzles used in one scan is limited to ¼ of the total number of nozzles in the nozzle column, a voltage drop in the drive circuit of the print head can be minimized, which in turn reduces variations in the voltage supplied to the heater. As a result, the threshold voltage Vth can be maintained without variations while at the same time the patch printing operation can be performed by changing only the drive pulse width. This allows for a precise measurement of the threshold drive pulse width and a precise setting of the drive energy.

As described above, with the first embodiment, an optimal setting of the drive energy, which takes into account variations among the heaters in the print head and voltage variations in the power supply of the ink jet printing apparatus, can be made accurately using an ordinary optical sensor. This in turn alleviates problems such as different volumes of ink droplets ejected from the print head level and ink ejection direction deviation, resulting in high-quality images being formed. This also prevents excess electric power from being supplied to the heaters of the print head, improving the longevity of the print head.

Figure 19B:
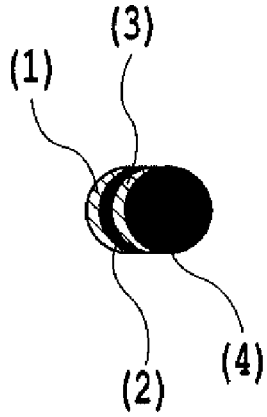
FIG. 19B is a schematic diagram showing how dots are formed when the Pth measuring patches are printed in the first embodiment, with a plurality of dots formed at slightly shifted positions.

In FIG. 19A an example case has been shown in which a dot d is formed by landing ink droplets, that are ejected in four scans, at the same position on the print medium. It is also possible to land ink droplets, ejected in different scans, in positions such that they are slightly deviated from one another. One such example is shown in FIG. 19B. In the figure, (1), (2), (3) and (4) represent an order of the scans used to form the dots d. Printing these dots can also form high-density patches in a way similar to that shown in FIG. 19A, producing the same effects as described above.

Second Embodiment

Next, the second embodiment of this invention will be explained.

Figure 21:
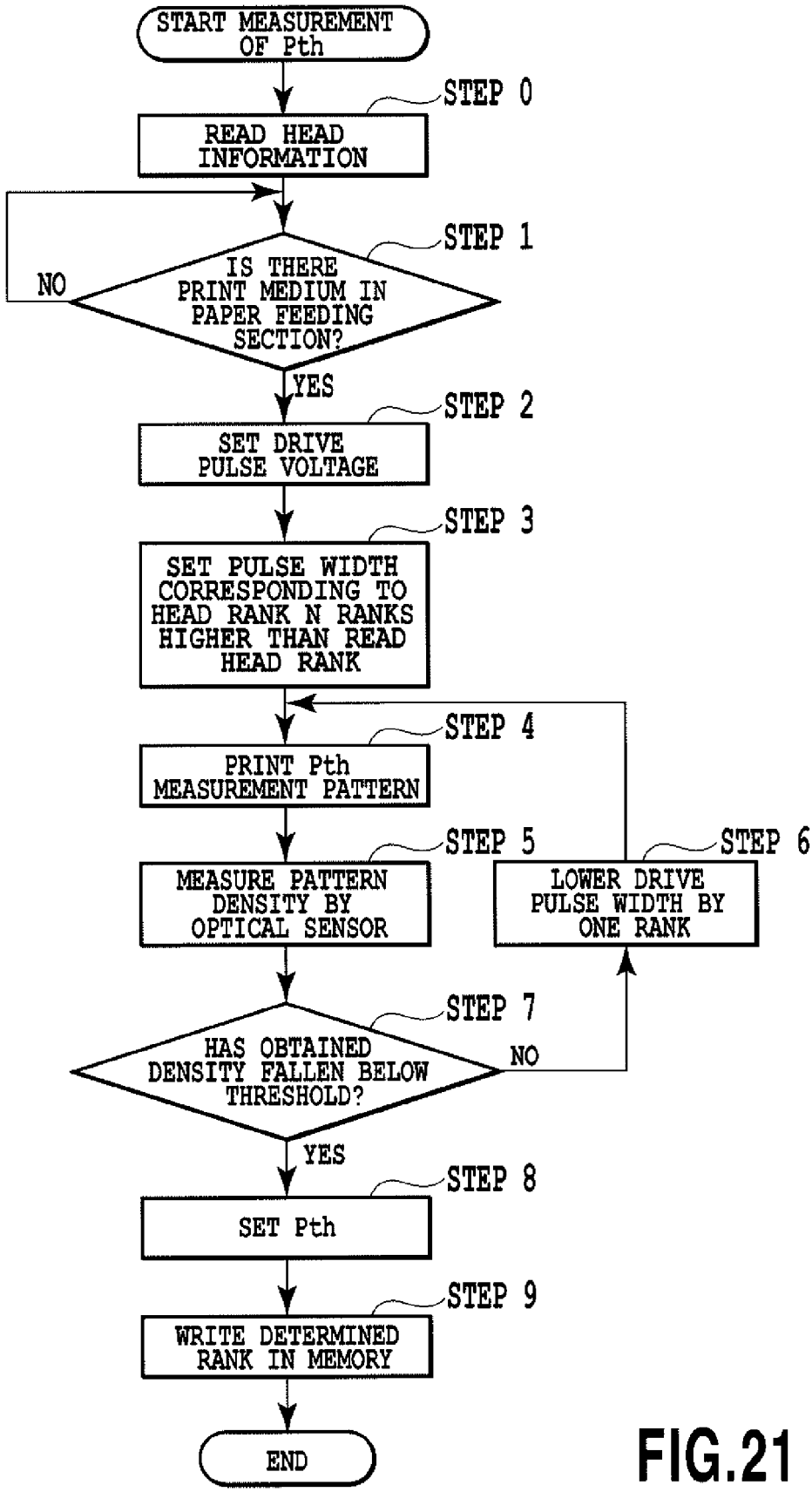
FIG. 21 is a flow chart showing a sequence of steps to measure Pth in a second embodiment.

In the first embodiment the threshold drive pulse width (1.21 μsec) corresponding to the maximum (63) of the head ranks is set (see step 3 in FIG. 13) after a voltage value of the drive pulse has been set. If the head rank stored in the memory of the print head H1001 is a relatively low head rank depending on the manufacturer, starting the measurement from the threshold drive pulse width corresponding to the maximum head rank can take much time to complete. To deal with this problem, the second embodiment performs a measurement operation as shown in a flow chart of FIG. 21.

That is, at step 0 a head rank stored in the memory of the print head H1001 is read out and, with the read head rank value as a criterion, a threshold drive pulse width corresponding to a head rank, which is higher than the read head rank by N ranks is set (step 3). For example, if the read head rank is 32nd rank, a threshold drive pulse width corresponding to a head rank, say, seven ranks higher than the read head rank, i.e. 39th rank (0.96 μsec), is set as the drive pulse width at the start of the measuring operation. This method can complete the measurement in a shorter time than when the threshold drive pulse width corresponding to the maximum rank 63 is set. The value of N may be determined by considering variations associated with the ink jet printing apparatus, such as variations in power supply voltage and variations in wiring resistance.

Third Embodiment

Next, the third embodiment of this invention will be explained.

In the third embodiment too, as in the first embodiment, the nozzle column in the print head is divided equally into four nozzle groups Ng and a multipass printing is performed which causes the four nozzle groups to scan over one and the same patch forming area a total of four times. In this embodiment also, the nozzle column has 768 nozzles (number 0 to number 767) with nozzle settings in each nozzle group made similar to those of the first embodiment.

It should be noted, however, that the third embodiment forms patches T by selecting a predetermined number of nozzles from among the nozzles making up each nozzle group Ng and performing a multipass printing using the selected nozzles. This is the point in which the third embodiment differs from the first embodiment. That is, the first embodiment uses all the nozzles (192 nozzles) of each nozzle group Ng in the print head as shown in FIG. 18B, whereas the third embodiment uses nozzles in each scan as shown in FIG. 23.

FIG. 23 shows an example of how the nozzles are used in each scan (first to fourth scan) in the third embodiment. In the example of FIG. 23, each printing scan is executed by using 16 nozzles that are chosen, every 12th nozzle, from 192 nozzles making up each nozzle group Ng.

Figure 22:
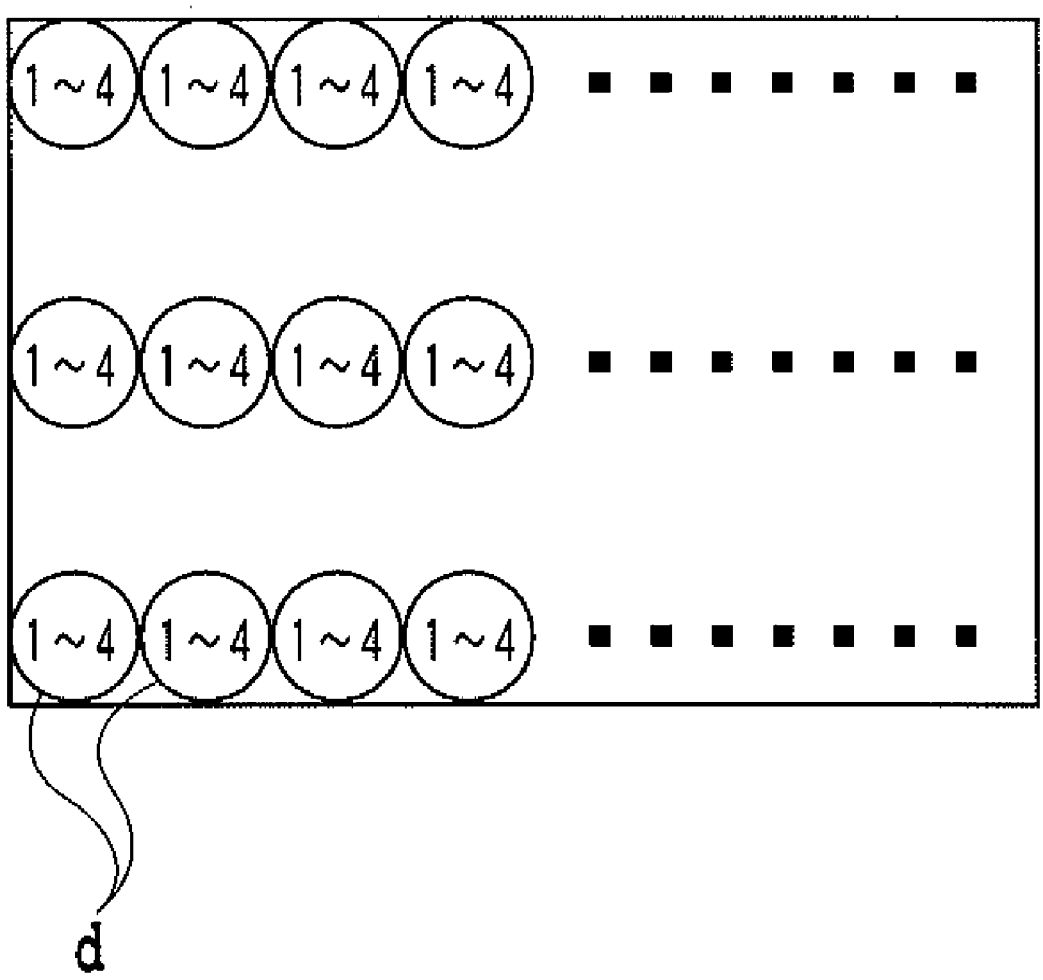
FIG. 22 is a schematic diagram showing how dots are formed when the Pth measuring patches are printed in a third embodiment.
Figure 24:
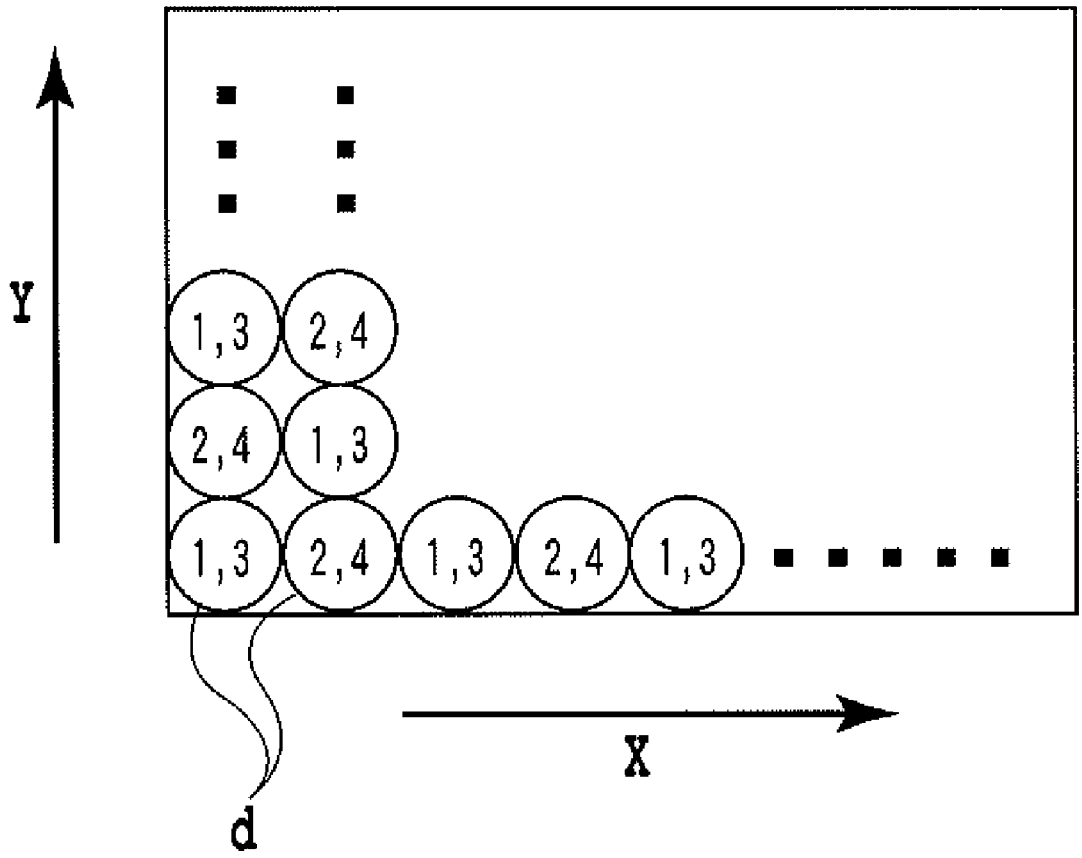
FIG. 24 is a schematic diagram showing how dots are formed when the Pth measuring patches are printed in a fourth embodiment.

That is, in the first scan, 16 nozzles shown in FIG. 23 are chosen from among 192 nozzles numbered 576-767 that make up one nozzle group. These selected nozzles eject ink droplets onto a patch forming area to form patches. Next, in the second scan, 16 nozzles shown in FIG. 23 are chosen from among nozzles numbered 384-575 and used for printing patches. Similarly, in the third and fourth scan, 16 nozzles selected from the associated nozzle group are used to print patches. With this printing operation, dots d such as shown in FIG. 22 are formed in the patch forming area. In the figure, numbers shown in dots d represent an order in which dots are formed.

The ink droplets ejected in the first to fourth scan land overlappingly at the same position on the print medium to form dots d. The density of each dot d therefore becomes higher than when the dots are formed by the 1-pass printing where only one ink droplet lands at one dot forming position. As a result, a change in density as the patch becomes faded increases when compared to that obtained by the 1-pass printing. It is therefore possible to reliably read by an optical sensor a density difference between a patch density immediately before it falls below the threshold density and a patch density immediately after it has fallen below the threshold density.

Further, in the third embodiment, since the number of nozzles that are used simultaneously is smaller than that of the first embodiment, a voltage drop during printing can be reduced further, making it possible to reliably avoid variations in power supply voltage and assure an appropriate measurement of the threshold drive energy.

Fourth Embodiment

Next, the fourth embodiment of this invention will be explained.

In the fourth embodiment, too, the nozzle column of the print head H1001 is divided equally into four nozzle groups and a multipass printing is performed using these nozzle groups, as in the preceding embodiments. It should be noted, however, that the fourth embodiment prints patches so that ink droplets ejected in a third scan overlap dots formed of ink droplets ejected in a first scan and that ink droplets ejected in a fourth scan overlap dots formed in a second scan.

More specifically, in the first scan, dots are formed at alternate dot positions in a raster direction or the main scan direction (X direction). Then, in the second scan, dots are formed between the dots formed by the first scan. Further, the third scan lands ink droplets at alternate dot positions so that the droplets overlap the dots formed in the first scan. In the fourth scan, ink droplets are landed at alternate dot positions so that they overlap the dots formed in the second scan.

As described above, since two ink dots are formed overlappingly at one and the same position on the print medium, each dot has an increased density. Thus, as in the first and second embodiment, it is possible to reliably read by an optical sensor a density difference between a patch immediately before its density falls below the threshold density and a patch immediately after its density has fallen below the threshold density. Further, since only one nozzle group is used to print in each scan, a voltage drop during printing can be reduced, minimizing variations in power supply voltage during the printing operation. Each scan may use all the nozzles of each nozzle group as in the first embodiment, or those nozzles selected from each nozzle group, as in the second embodiment.

Also in a bidirectional printing that performs printing by ejecting ink droplets in both forward and backward scans, there is a time of one reciprocal scan for all dot forming positions from a preceding ink droplet landing at any dot position to a subsequent ink droplet overlappingly land at the same dot position. During this one reciprocal scan, the preceding ink droplet soaks into the print medium and fixes there to some degree, followed by the subsequent ink droplets landing on the preceding dot. As a result, an increased volume of colorant fixes on the surface of the print medium, forming a high-density dot. Further, in the fourth embodiment, dots formed in the first and third scan and dots formed in the second and fourth scan are alternately staggered in a column direction or subscan direction (Y direction). This arrangement can increase a center-to-center distance between ink dots landing in the same scan at adjacent positions, minimizing an overlapping and combining between unfixed ink droplets landing in the same scan. That is, ink droplets can be independently fixed, which in turn contributes advantageously to forming high-density dots.

Fifth Embodiment

Next, the fifth embodiment of this invention will be explained.

Figure 25:
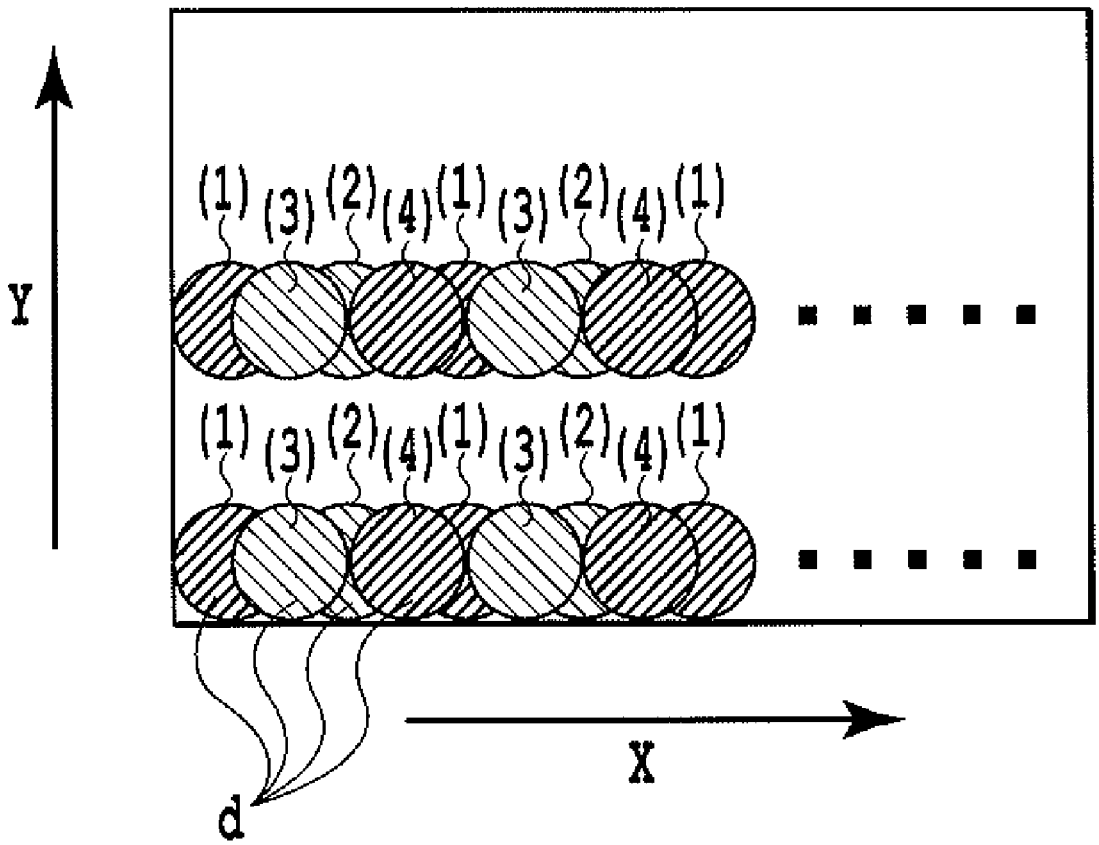
FIG. 25 is a schematic diagram showing how dots are formed when the Pth measuring patches are printed in a fifth embodiment.
Figure 26:
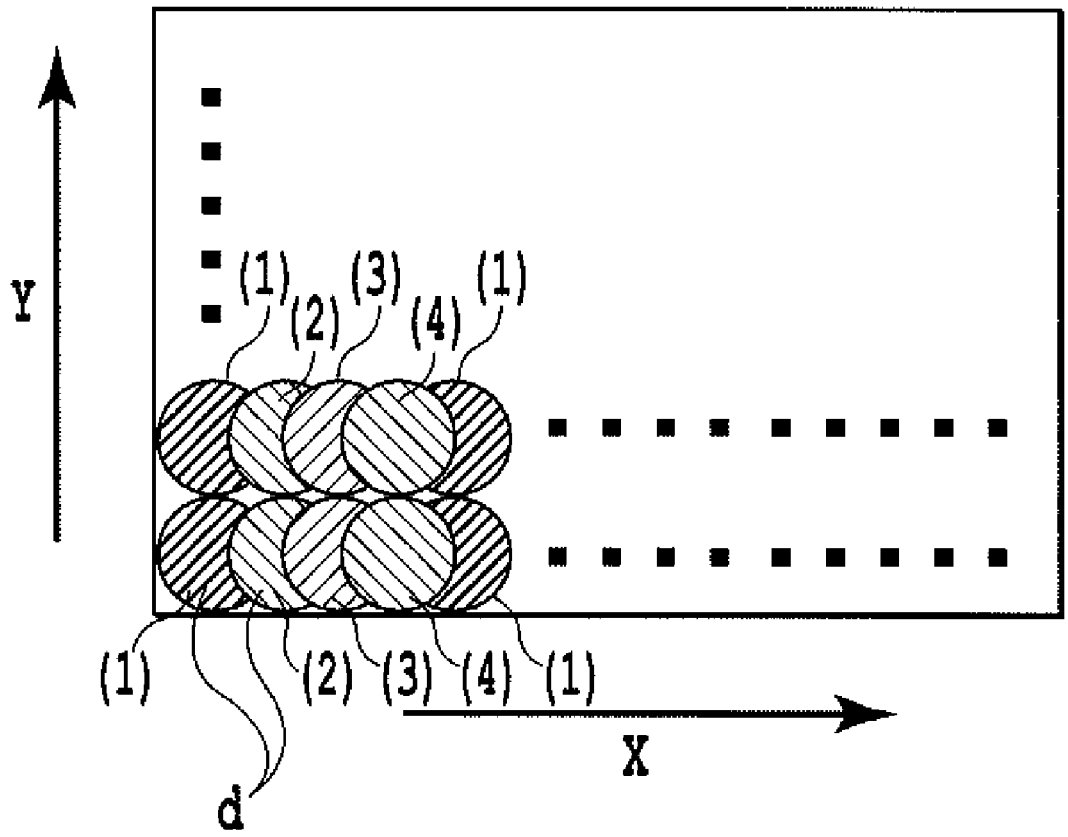
FIG. 26 is a schematic diagram showing how dots are formed when the Pth measuring patches are printed in a sixth embodiment.

In the fifth embodiment, only a predetermined number of nozzles in each of the nozzle groups making up the nozzle column of the print head H1001 are used in the first to fourth scan to form dots, as shown in FIG. 25. It is noted, however, that in FIG. 25 alternate nozzles are selected in each nozzle group. In FIG. 25, numbers (1), (2), (3), (4) attached to individual dots represent an order of scan in which they are formed.

In the patch printing, the first scan lands ink droplets at alternate dot positions in the raster direction or the main scan direction (X direction) to form dots d(1). The second scan lands ink droplets between the dots d(1) formed by the first scan to form dots d(2). Further, the third scan lands ink droplets at alternate dot positions to form dots d(3) such that each of the dots d(3) overlaps both the dot formed by the first scan and the dot formed by the second scan. After this, in the fourth scan, ink droplets are landed between the dots formed by the third scan to form dots d(4). Thus, the dots formed here also overlap the dots d(1) and d(2) formed by the first and second scan.

As described above, since in the fifth embodiment the dots d(3) and d(4) formed by the third and fourth scan overlap the dots d(1) and d(2) formed by the first and second scan, the density of the dot forming areas can be enhanced, producing similar effects to those of the second embodiment.

Sixth Embodiment

Next, the sixth embodiment will be explained. In the sixth embodiment, dots d formed by the first to fourth scan are each printed to partly overlap a dot formed by the immediately preceding scan. In the following an example case will be explained in which dots are printed to overlap each other by one-half dot. It is noted that the amount of overlap is not limited to one-half dot and the only requirement is that adjoining dots partly overlap each other.

In the first scan, ink droplets are landed at alternate dot positions to form dots d(1); in the second scan ink droplets are landed at such positions that they overlap the dots d(1) formed in the first scan by one-half dot, to form dots d(2); further the third scan lands ink droplets at positions such that they overlap the dots d(2) formed in the second scan by one-half dot, to form dots d(3); and the fourth scan lands ink droplets at positions such that they overlap the dots d(3) formed in the third scan by one-half dot, to form dots d(4). In this way, dots are formed successively to overlap the adjoining dots by one-half dot, making the density at the dot forming positions high, thereby enhancing the accuracy of measurement on the part of an optical sensor. Further, the number of nozzles used in each scan is one-fourth the total number of nozzles, so a voltage drop can be reduced, allowing the printing operation to be executed while minimizing variations in power supply voltage.

Seventh Embodiment

Next, the seventh embodiment of this invention will be described.

The preceding embodiments make the density of each dot formed by a multipass printing higher than that produced by the 1-pass printing, by overlappingly landing a plurality of ink droplets. The seventh embodiment using the multipass printing prints patches by landing ink droplets at the same landing positions as those of the 1-pass printing. That is, the printing is done by landing one ink droplet at each dot forming position in a plurality of scans. This method also can form patches with higher densities than those of the 1-pass printing.

Figure 27A:
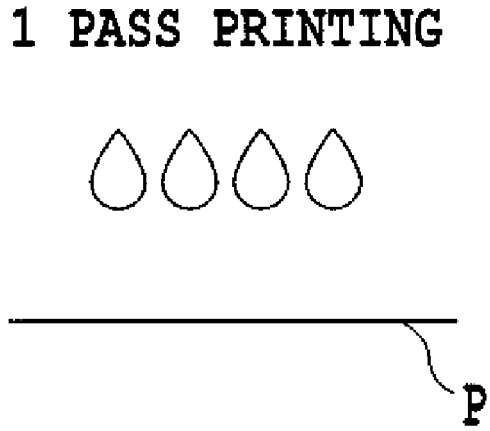
FIG. 27A and FIG. 27B schematically illustrates how ink droplets that have landed on a print medium during a 1-pass printing soak into the medium.
Figure 27B:
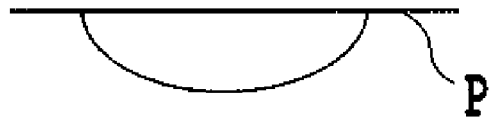
Figure 28A:
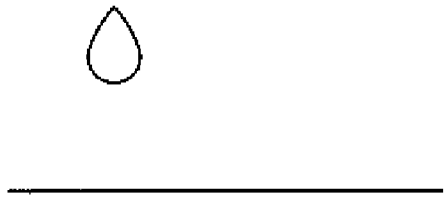
FIG. 28A to FIG. 28E schematically illustrates how ink droplets that have landed on a print medium during a multi-pass printing soak into the medium in a seventh embodiment.
Figure 28B:
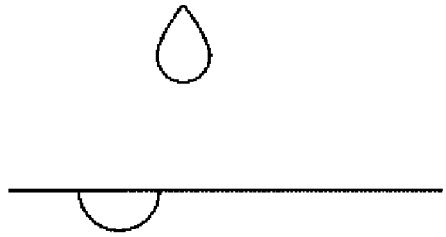
Figure 28C:
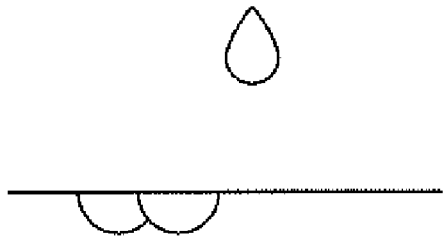
Figure 28D:
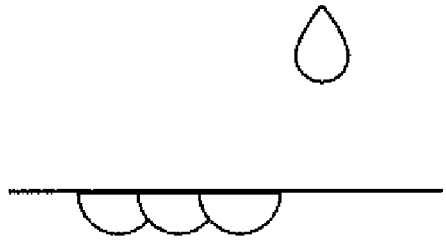
Figure 28E:
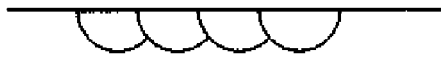

The reason for the above will be explained by referring to FIG. 27 and FIG. 28. In printing patches using the 1-pass printing, ink droplets are ejected simultaneously from nozzles of the print head and land on the print medium P at the same time, as shown in FIG. 27(*a*). The ink droplets that have landed on the print medium combine together and their colorant sinks deeply into the print medium P, as shown in FIG. 27(*b*). As a result, the amount of colorant remaining on the surface of the print medium becomes small, leaving the printed patches with a relatively low density.

When, on the other hand, a multipass printing is performed, dots at adjoining positions are formed in different scans, as shown in FIG. 28(*a*) to 28(*e*). That is, the adjoining dots are formed with a large time difference in between. So, only after the ink droplet that landed in a preceding scan is fixed, an ink droplet from the next scan lands next to it. The ink droplets that land at the adjoining positions therefore can independently fix in the print medium. As a result, the amount of colorant that penetrates into the print medium becomes small, leaving a large amount of colorant fixing near the surface of the print medium P. Thus, the multipass-printed patches have higher densities than those printed by the 1-pass printing, allowing for a precise measurement of density by an optical sensor. Further, the multipass printing, since it has a reduced number of nozzles that are driven in one scan, can reduce power supply voltage variations caused by voltage drop more than the 1-pass printing.

Eighth Embodiment

Next, the eighth embodiment of this invention will be explained.

Figure 29:
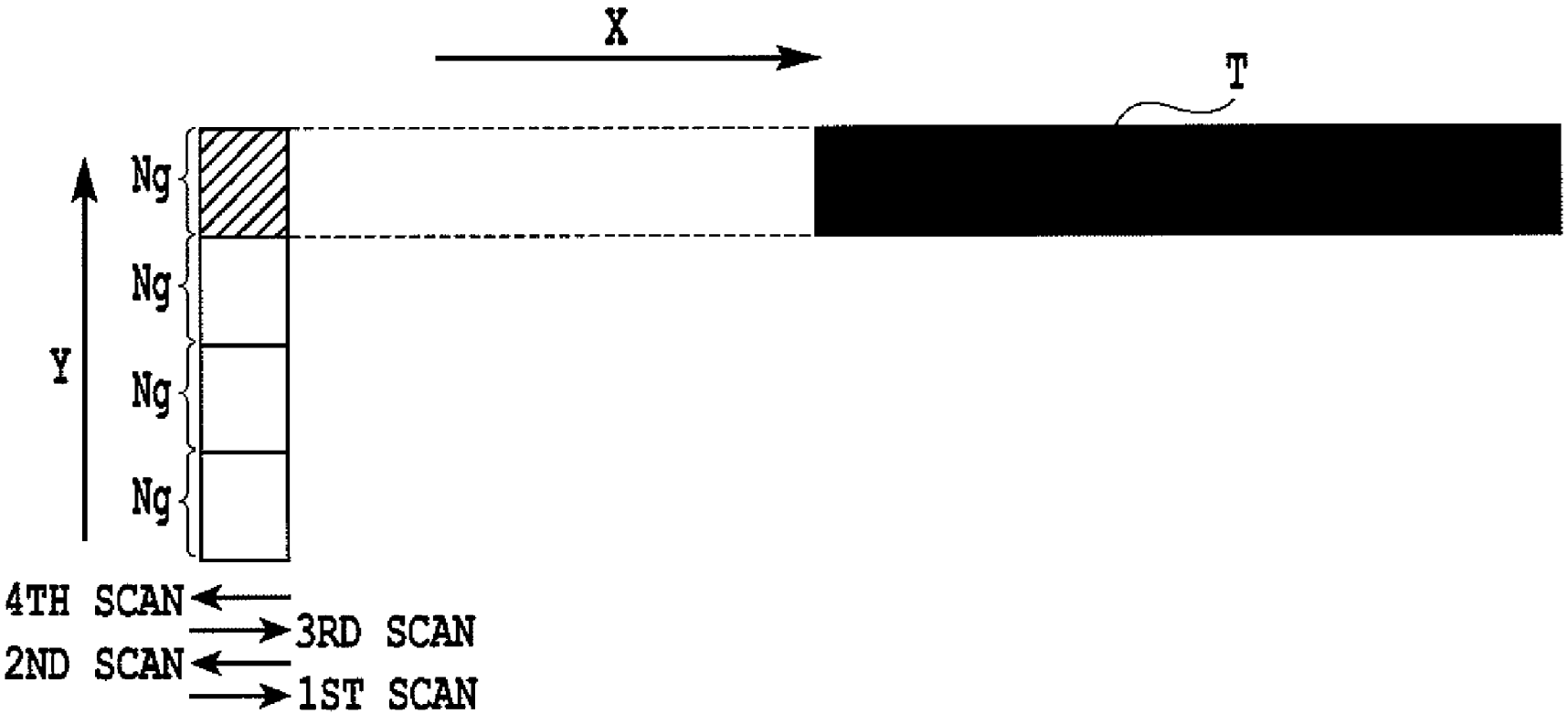
FIG. 29 schematically illustrates how a multipass printing is performed when printing the Pth measuring patches in an eighth embodiment.

The preceding embodiments have described examples of the multipass printing in which different nozzle groups scan over one and the same patch forming area. In the eighth embodiment, on the other hand, the multipass printing is performed by scanning of the same nozzle group over one patch forming area a plurality of times to print patches T, as shown in FIG. 29. That is, while in the preceding embodiments, the print medium is moved a distance corresponding to the width of the nozzle group after each scan, the eighth embodiment does not execute the print medium feeding during a plurality of scans that are performed to print the patch. This method, as in the above embodiments, can minimize voltage drops and print high-density patches, allowing for a precise measurement of threshold energy.

Ninth Embodiment

Next, the ninth embodiment of this invention will be explained.

In the preceding embodiments, measurements are taken of the threshold drive energy by fixing the drive voltage at a constant value and changing the drive pulse width stepwise. The threshold drive energy can also be measured by fixing the drive pulse width at a constant value and changing the drive voltage stepwise. The ninth embodiment employs the latter measurement method.

This ninth embodiment first fixes the drive pulse width at 1/k the pulse width used for the normal printing operation. Next, the drive voltage is set to a maximum value by the power supply circuit of FIG. 11 and a multipass printing is performed to print a patch T.

Next, a density of the patch is read by an optical sensor and a check is made to see whether the measured density is lower than the threshold. If the measured density is not lower than the threshold, the drive voltage is lowered by a predetermined voltage value by using the power supply circuit and then the patch printing is performed again. This series of steps is repeated until the density read by the optical sensor falls below the threshold density. When the patch density falls below the threshold density, a voltage immediately preceding that voltage used to form the patch is set as the threshold drive voltage Vth. After this, the drive pulse width is returned to a pulse width used for normal printing, and an optimal ejection energy is set by using this pulse width and the measured threshold drive voltage Vth. With this method also, the threshold drive energy can be set as in the case where the drive pulse width is changed stepwise.

Other Embodiments

In the above embodiments, the threshold drive energy is measured by progressively lowering the drive voltage or drive pulse width used to print patches until ink droplets are no longer ejected. It is also possible to measure the threshold drive energy by setting the first drive voltage at a small voltage or drive pulse width to be used in printing patches at a small pulse width and then progressively increasing the drive voltage or drive pulse width until the print head begins to eject ink droplets. That is, the drive pulse width or drive voltage when ink droplets have begun to be ejected may be set as a threshold.

The threshold density may be set not only when ink is no longer ejected completely but also when the patch begins to fade or when an intermediate condition between the two occurs.

It is also possible to store the drive pulse value set by the above embodiments in the printing apparatus body or a storage sections in the print head and to use the value stored in the storage sections until the drive condition setting mode is started next.

Also, even if there is no user request, the above measurement operation may also be performed automatically whenever a condition is established that will affect an ejection performance of the print head, such as the number of ejections of ink droplets and the number of pages printed. For example, when a count value representing the number of ejections has reached a predetermined value (e.g., the 8th of 10 ejections or 108 ejections) or when a printed volume, converted into the number of printing sheets of standard size, has reached a predetermined number (e.g., 1000 A4-size sheets), the user may be prompted to shift to the drive condition setting mode.

In the above embodiments the ink jet printing apparatus have been shown to perform printing by using a print head that has electrothermal conversion elements (heaters) as ink droplet ejection energy generation elements. This invention, however, can also be applied to ink jet printing apparatus with a print head having electromechanical conversion elements, such as piezoelectric elements, or with a print head of other thermal systems. Further, this invention is also applicable to a so-called full-line type ink jet printing apparatus which has a print head with its length corresponding to a maximum printable width of a print medium. That is, even in the full-line type ink jet printing apparatus, this invention can be applied as long as a plurality of nozzle columns that eject a different color each are arranged in a print medium feeding direction. In that case, since the nozzle columns each scan over the print medium, the same patch forming area is scanned a plurality of times as in the serial type.

Further, this invention is applicable both to a system composed of a plurality of devices (e.g., host computer, interface device, reader, printer, etc.) and to a system composed of a single device (e.g., copying machine, facsimile, etc.).

Further, in this invention, storage media (or recorded media) containing program codes that realize the functions of the above embodiments may be fed into a system or device. In that case, the object of this invention can also be achieved by a computer of the system or device (or CPU or MPU) reading and executing the program codes stored in the storage media. Thus, the program codes themselves, that are read from the storage media, implement the functions of the above embodiments, so the storage media containing the program codes constitute the present invention. Further, the functions of the above embodiments may also be realized by having an operating system—which is running on the computer according to instructions of the program codes read by the computer—execute a part or all of the actual processing.

With this invention, the drive conditions for the print head can be set precisely by considering variations in the print head (heater resistances, resistances of heater drive elements, head wiring resistances, heater thermal efficiencies, etc.) and variations on the printer side (power supply capacity, power supply line resistances, etc.). This allows for stabilized ink ejection and improved durability of the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-265359, filed Sep. 28, 2006, which is hereby incorporated by reference herein in its entirety.

What is claimed is:

1. An ink jet printing apparatus for printing on a print medium by driving printing elements of a print head to eject ink onto the print medium, the ink jet printing apparatus comprising:

patch printing unit that prints on the print medium a plurality of patches corresponding to different drive conditions by driving the printing elements based on the different drive conditions; and a determination unit that determines a drive condition to be used from among the plurality of drive conditions corresponding to the plurality of patches, wherein the patch printing unit prints each of the plurality of patches in a plurality of scans of the print head.

2. An ink jet printing apparatus according to claim 1, wherein the patch printing unit uses all of the plurality of printing elements of the print head to print each of the plurality of patches.

3. An ink jet printing apparatus according to claim 1, wherein the patch printing unit uses a part of the plurality of printing elements of the print head to print each of the plurality of patches.

4. An ink jet printing apparatus for printing on a print medium by applying an electric energy to printing elements of a print head to eject ink onto the print medium, the ink jet printing apparatus comprising:

a patch printing unit that prints on the print medium a plurality of patches corresponding to different levels of electric energy by changing stepwise the electric energy applied to the printing elements;

a sensor that reads the patches printed by the patch printing unit and corresponding to the different levels of electric energy; and a determination unit that determines an electric energy to be supplied to the printing elements according to a result of reading by the sensor, wherein the patch printing unit prints each of the patches corresponding to the different levels of electric energy in a plurality of scans of the print head.

5. An ink jet printing apparatus according to claim 4, wherein the patch printing unit uses all of the plurality of printing elements of the print head to print each of the plurality of patches.

6. An ink jet printing apparatus according to claim 4, wherein the patch printing unit uses a part of the plurality of printing elements of the print head to print each of the plurality of patches.

7. An ink jet printing apparatus according to claim 4, wherein the sensor reads a density of each of the patches;

wherein the determination unit determines an electric energy to be supplied to the printing elements according to whether the density read by the sensor has fallen below a preset density;

wherein if, after an electric energy corresponding to a predetermined level has been applied to the printing elements to print the patch, a density of the printed patch read by the sensor is greater than or equal to a predetermined density, the patch printing unit lowers the electric energy to be supplied to the printing elements by one level and prints a patch again;

wherein the determination unit determines as a threshold a level of electric energy immediately before the density of the patch falls below the predetermined density and also determines as the electric energy to be supplied to the printing elements an electric energy obtained by multiplying the threshold by a predetermined coefficient.

8. An ink jet printing apparatus according to claim 4, wherein the sensor reads a density of each of the patches;

wherein the determination unit determines an electric energy to be supplied to the printing elements according to whether the density read by the sensor has risen above a preset density;

wherein if, after an electric energy corresponding to a predetermined level has been applied to the printing elements to print the patch, a density of the printed patch read by the sensor is less than or equal to a predetermined density, the patch printing unit raises the electric energy to be supplied to the printing elements by one level and prints a patch again;

wherein the determination unit determines as a threshold an electric energy corresponding to a level where the density of the patch has risen above the predetermined density and also determines as the electric energy to be supplied to the printing elements an electric energy obtained by multiplying the threshold by a predetermined coefficient.

9. An ink jet printing apparatus according to claim 4, wherein the patch printing unit performs a patch printing such that a width of the patch in an array direction of the printing elements is less than or equal to a width of a reading area of the sensor in the printing element array direction.

10. An ink jet printing apparatus according to claim 2, wherein the patch printing unit changes the electric energy stepwise by changing stepwise an application time of a drive voltage applied to the printing elements while keeping the drive voltage constant.

11. An ink jet printing apparatus according to claim 4, wherein the patch printing unit changes the electric energy stepwise by changing stepwise a drive voltage applied to the printing elements while keeping an application time of the drive voltage constant.

12. An ink jet printing apparatus according to claim 4, further comprising;

a storage section that stores values representing electric energies corresponding to each of a plurality of levels which enable printing the patches and head ranks corresponding to the values; and a rank reading unit that reads out the head rank preset corresponding to the print head;

wherein the patch printing unit reads out the value from the storage section, the value corresponding to a head rank which is shifted N ranks from the head rank read out by rank reading unit, sets the electric energy corresponding to the read out value as a reference electric energy, changes stepwise the electric energy from the reference electric energy, and prints the patches by using the electric energy changed stepwise.

* * * * *